US010514229B2

(12) United States Patent
Shaffer et al.

(10) Patent No.: US 10,514,229 B2
(45) Date of Patent: Dec. 24, 2019

(54) CROSSBOW COCKING SYSTEM

(71) Applicant: Hunter's Manufacturing Company, Inc., Suffield, OH (US)

(72) Inventors: Michael Shaffer, Mogadore, OH (US); Gary Smith, East Canton, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 16/417,745

(22) Filed: May 21, 2019

(65) Prior Publication Data

US 2019/0271523 A1 Sep. 5, 2019

Related U.S. Application Data

(63) Continuation of application No. 15/910,416, filed on Mar. 2, 2018, now Pat. No. 10,295,298.

(60) Provisional application No. 62/529,022, filed on Jul. 6, 2017.

(51) Int. Cl.

| | |
|---|---|
| ***F41B 5/18*** | (2006.01) |
| ***F41B 5/14*** | (2006.01) |
| ***F41B 5/12*** | (2006.01) |

(52) U.S. Cl.

CPC ..... *F41B 5/1469* (2013.01); *F41B 5/12* (2013.01); *F41B 5/148* (2013.01); *F41B 5/123* (2013.01)

(58) Field of Classification Search

CPC ..... F41B 5/12; F41B 5/123; F41B 5/1469; F41B 5/148

USPC ..... 124/25, 86

See application file for complete search history.

(56) References Cited

U.S. PATENT DOCUMENTS

| | | | |
|---|---|---|---|
| 2,092,361 | A | 9/1937 | Shirn |
| 3,043,287 | A | 7/1962 | Nelson |
| 3,561,419 | A | 2/1971 | Cucuzza, Sr. |
| 3,670,711 | A | 6/1972 | Firestone |
| 3,739,765 | A | 6/1973 | Moore |
| 4,192,281 | A | 3/1980 | King |
| 4,246,883 | A | 1/1981 | Ash |
| 4,593,675 | A | 6/1986 | Waiser |
| 4,603,676 | A | 8/1986 | Luoma |
| 4,649,892 | A | 3/1987 | Bozek |
| 4,662,345 | A | 5/1987 | Stephens |
| 4,665,885 | A | 5/1987 | Glomski et al. |
| 4,719,897 | A | 1/1988 | Gaudreau |
| 4,721,092 | A | 1/1988 | Waiser |
| 4,942,861 | A | 7/1990 | Bozek |

(Continued)

OTHER PUBLICATIONS

A Guide to the Crossbow, by W.F. Paterson, published by the Society of Archer-Antiquaries, 1990.

(Continued)

*Primary Examiner* — Alexander R Niconovich

(74) *Attorney, Agent, or Firm* — Emerson Thomson Bennett, LLC

(57) ABSTRACT

A crossbow cocking system may include a sled having first and second arms, an elongated cocking cable, a first handle, a second handle, a first engagement feature and a second engagement feature. The first and second engagement features may be used to engage the first handle to the first arm and the second handle to the second arm, respectively. Each engagement feature may include at least one cavity and at least one protrusion that is received in the cavity for engagement. The handles may be disengaged to permit a user to cock the crossbow.

20 Claims, 32 Drawing Sheets

(56) References Cited

U.S. PATENT DOCUMENTS 5,115,795 A 5/1992 Farris
5,205,267 A 4/1993 Burdick
5,215,069 A 6/1993 Liu
5,220,906 A 6/1993 Choma
5,243,956 A * 9/1993 Luehring ..... F41B 5/12 124/25
5,433,186 A 7/1995 Corwin
5,437,260 A 8/1995 King
5,445,139 A 8/1995 Bybee
5,553,596 A 9/1996 Bednar
5,598,829 A 2/1997 Bednar
5,649,520 A 7/1997 Bednar
5,678,528 A 10/1997 Hadley
5,987,724 A 11/1999 Kleman
6,095,128 A 8/2000 Bednar
6,286,496 B1 * 9/2001 Bednar ..... F41B 5/123 124/25
6,874,491 B2 * 4/2005 Bednar ..... F41B 5/10 124/25
6,913,007 B2 * 7/2005 Bednar ..... F41B 5/123 124/25
7,100,590 B2 * 9/2006 Chang ..... F41B 5/123 124/25
7,624,725 B1 * 12/2009 Choma ..... F41B 5/1469 124/25
7,784,453 B1 8/2010 Yehle
8,443,790 B2 * 5/2013 Pestrue ..... F41B 5/1469 124/25
8,499,753 B2 * 8/2013 Bednar ..... F41B 5/123 124/25
9,285,182 B2 3/2016 Bendar et al.
9,618,295 B1 4/2017 Rentz
10,107,584 B1 * 10/2018 Anderson ..... F41B 5/1469
10,175,025 B1 * 1/2019 Fehringer ..... F41B 5/1469
2006/0086346 A1 * 4/2006 Middleton ..... F41B 5/12 124/25
2008/0149084 A1 6/2008 Whalen et al.
2010/0170488 A1 * 7/2010 Rasor ..... F41A 11/02 124/25
2011/0232619 A1 * 9/2011 Bednar ..... F41B 5/12 124/86
2012/0037139 A1 * 2/2012 Barnett ..... F41B 5/1469 124/86
2014/0069403 A1 * 3/2014 Simonds ..... F41B 5/123 124/25
2015/0000646 A1 * 1/2015 Schley ..... F41B 5/1469 124/86
2015/0013654 A1 * 1/2015 Bednar ..... F41B 5/1469 124/25
2017/0003098 A1 * 1/2017 Houle ..... F41B 5/12
2017/0343313 A1 * 11/2017 Ozanne ..... F41B 5/1469

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

CROSSBOW COCKING SYSTEM

CROSS-REFERENCE TO RELATED APPLICATIONS

This application is a continuation of U.S. patent application Ser. No. 15/910,416 filed Mar. 2, 2018, entitled CROSSBOW COCKING SYSTEM, which claims the benefit of U.S. Provisional Application No. 62/529,022, filed Jul. 6, 2017, entitled CROSSBOW COCKING SYSTEM, the entirety of which is fully incorporated by reference herein.

BACKGROUND

The present subject matter is directed to apparatuses and methods regarding crossbows. More specifically the present subject matter is directed to apparatuses and methods for cocking a crossbow.

Crossbows have been used for many years as a weapon for hunting and fishing, and for target shooting. Crossbows typically comprise a bowstring movable between a cocked and uncocked position. The operation of moving the bowstring to the cocked position is a cocking operation.

Cocking operations are sometime assisted using a cocking device. Cocking devices may comprise simple pulley systems operated by pulling one or more handles by hand by an associated user. The design of the one of more handles can influence user comfort or ergonomics or both during a cocking operation. It remains desirable to produce a cocking device with handles that improve user comfort or ergonomics during a cocking operation.

SUMMARY

Provided is a crossbow cocking system comprising a sled, an elongated cocking cable, a first handle, and a second handle. The sled may have a first side having a first bowstring retainer, a first arm having a first set of handle engagement features adapted for engagement with a first handle, and a first pulley rotatably engaged with the first arm; and a second side having a second bowstring retainer, and a second arm having a second set of handle engagement features adapted for engagement with a second handle, a second pulley rotatably engaged with the second arm. The first and the second handle may each be engaged to the elongated cocking cable, and be ergonomically adapted to permit an associated user to operate the each handle during a cocking operation with a hand in a vertical hand position.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DETAILED DESCRIPTION

Figure 1:
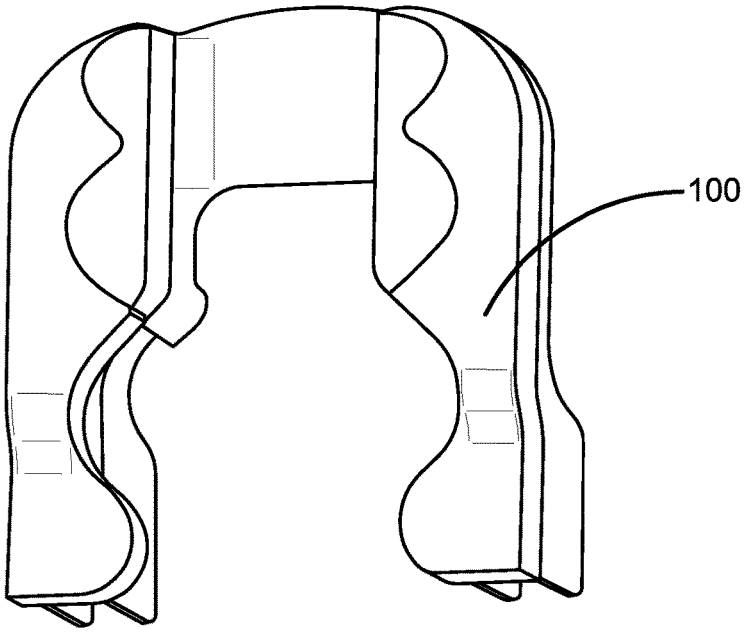
FIG. 1 is a perspective view of one embodiment of a crossbow cocking sled.
Figure 2:
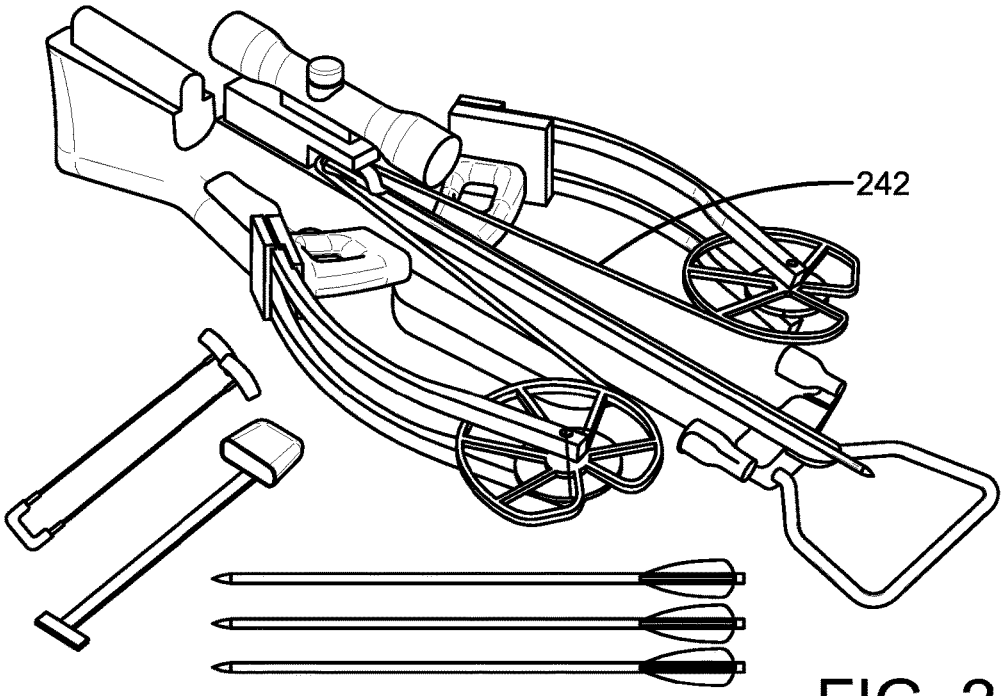
FIG. 2 is a perspective view of one embodiment of a crossbow and associated components.
Figure 3:
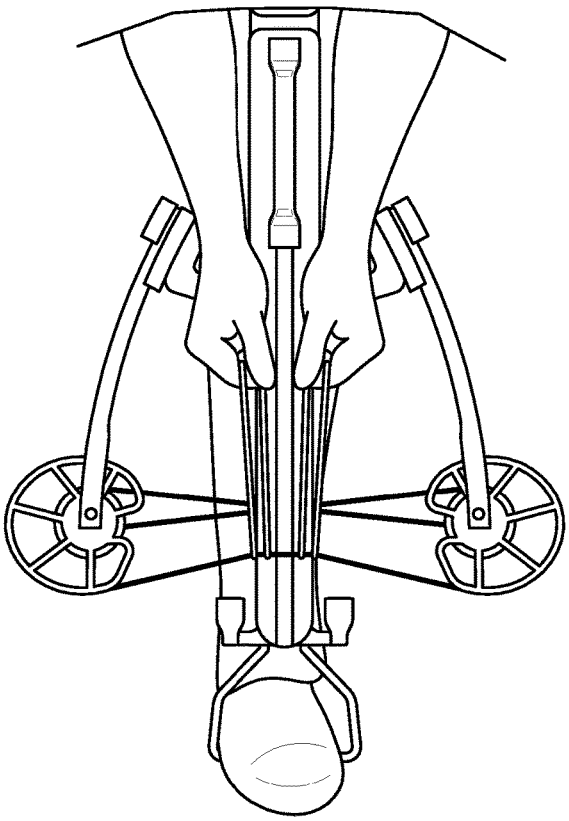
FIG. 3 is a picture of a crossbow being cocked by a user.
Figure 4:
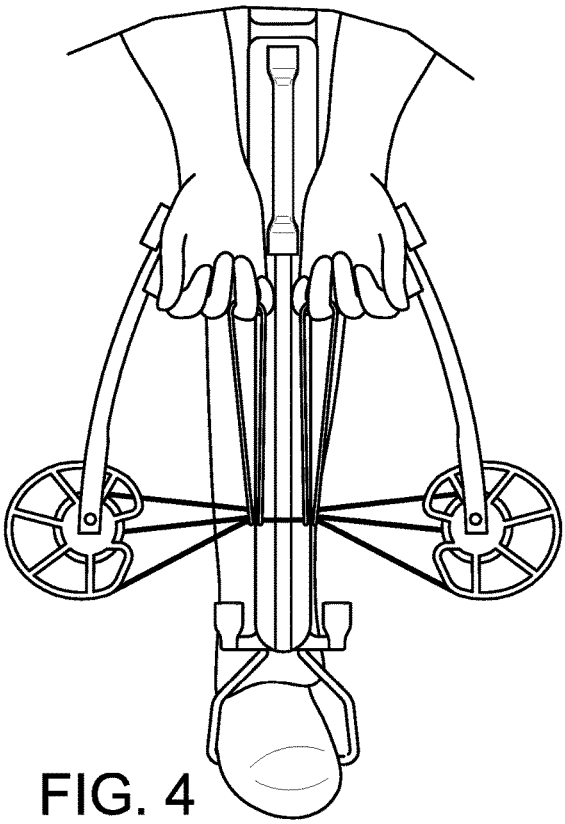
FIG. 4 is a picture of a crossbow being cocked by a user.
Figure 5:
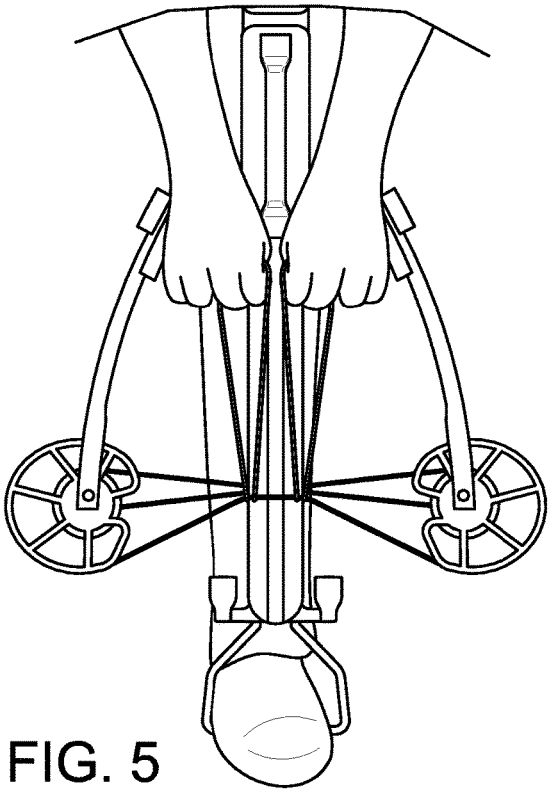
FIG. 5 is a picture of a crossbow being cocked by a user.
Figure 6:
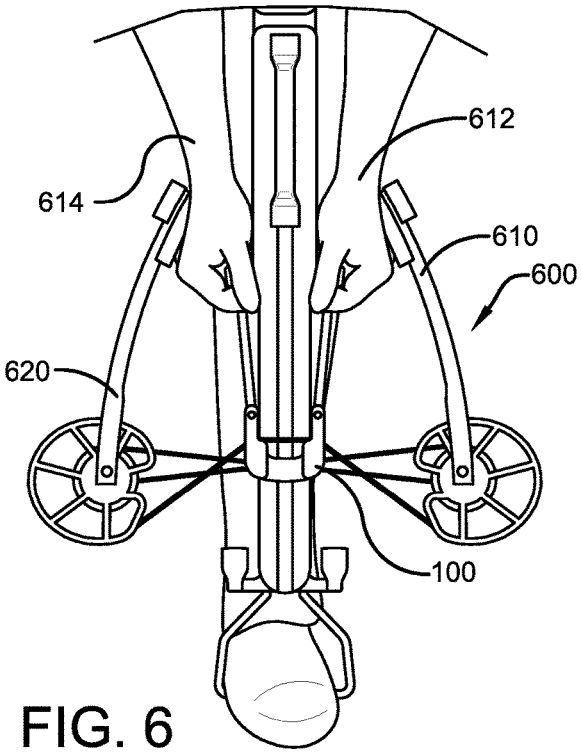
FIG. 6 is a picture of a crossbow being cocked by a user.
Figure 7:
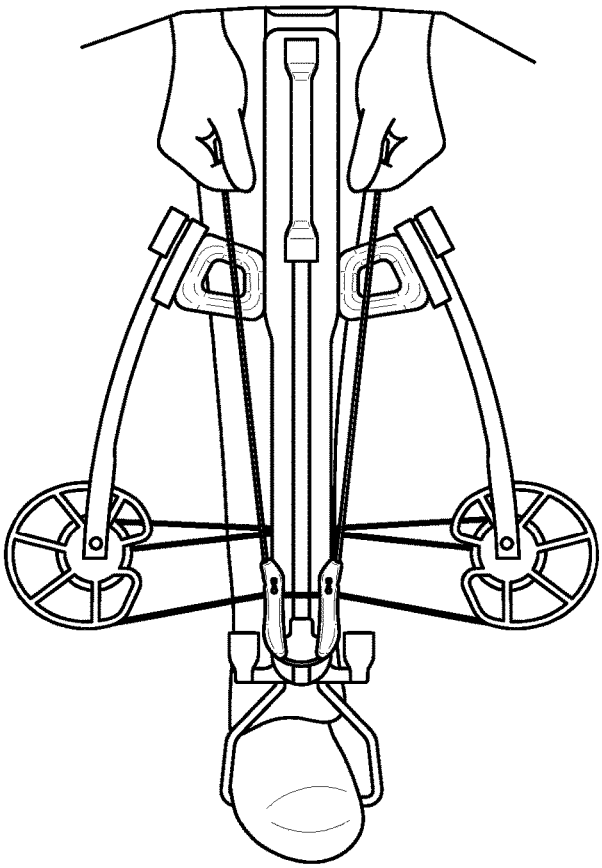
FIG. 7 is a picture of a crossbow being cocked by a user.
Figure 8:
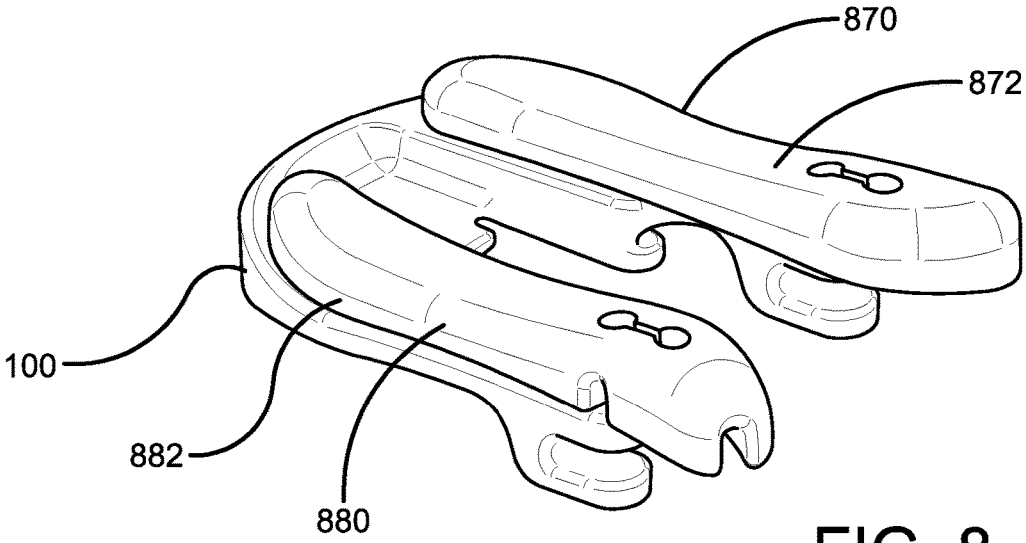
FIG. 8 is a perspective view of one embodiment of a crossbow cocking system.
Figure 9:
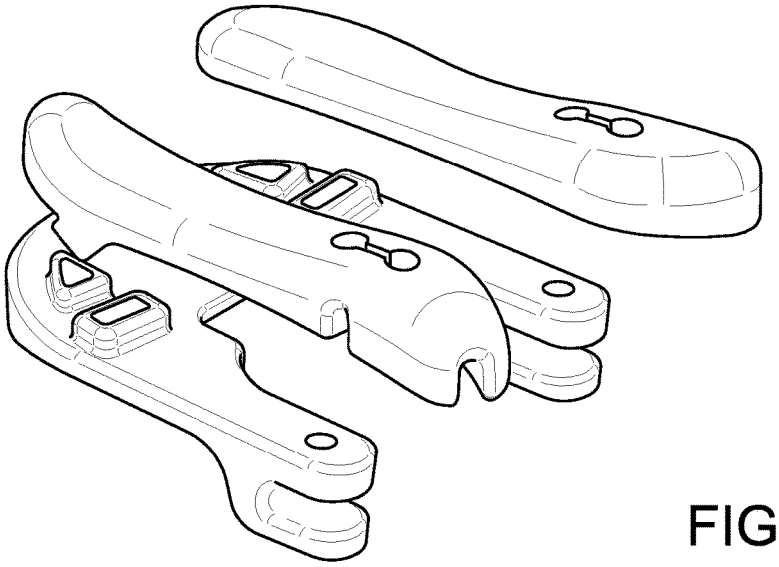
FIG. 9 is a perspective exploded view of one embodiment of a crossbow cocking system.
Figure 10:
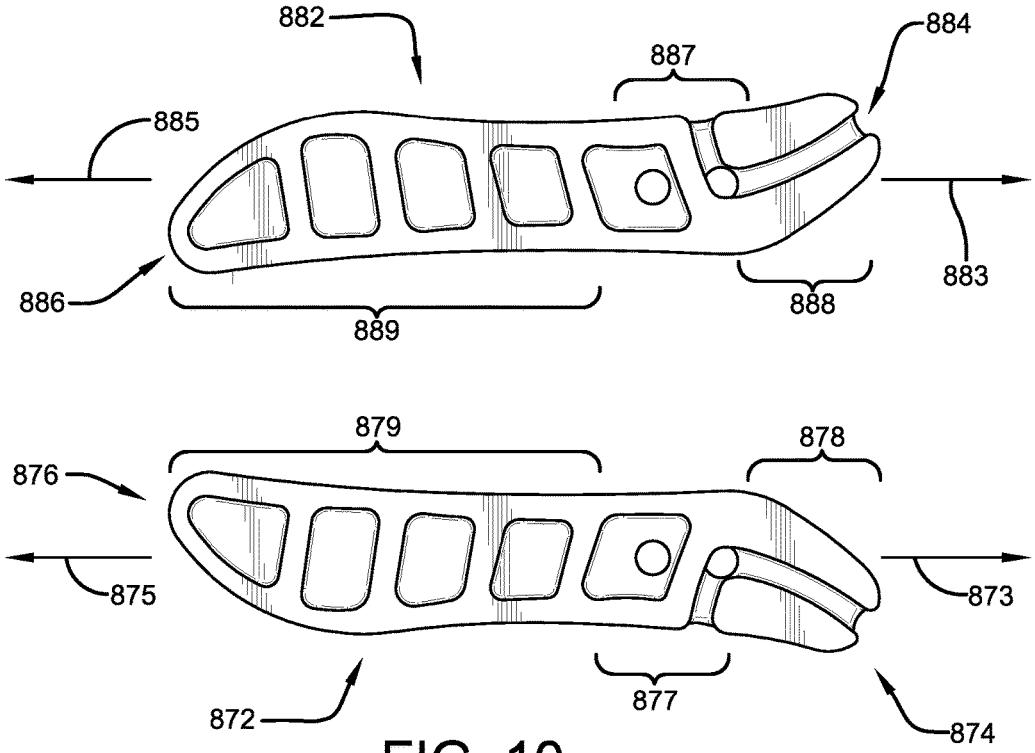
FIG. 10 is a view of one embodiment of the underside of the handles of a crossbow cocking system.
Figure 11:
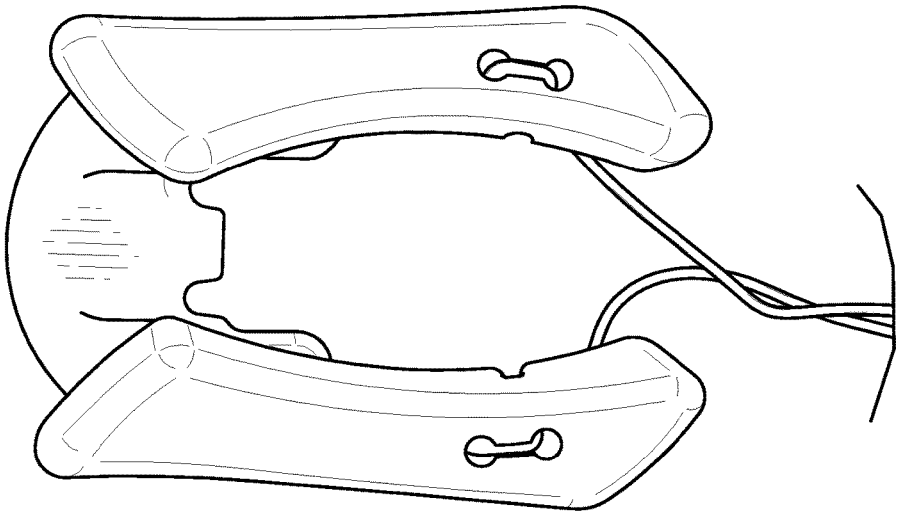
FIG. 11 is a view of one embodiment of a crossbow cocking system.
Figure 12:
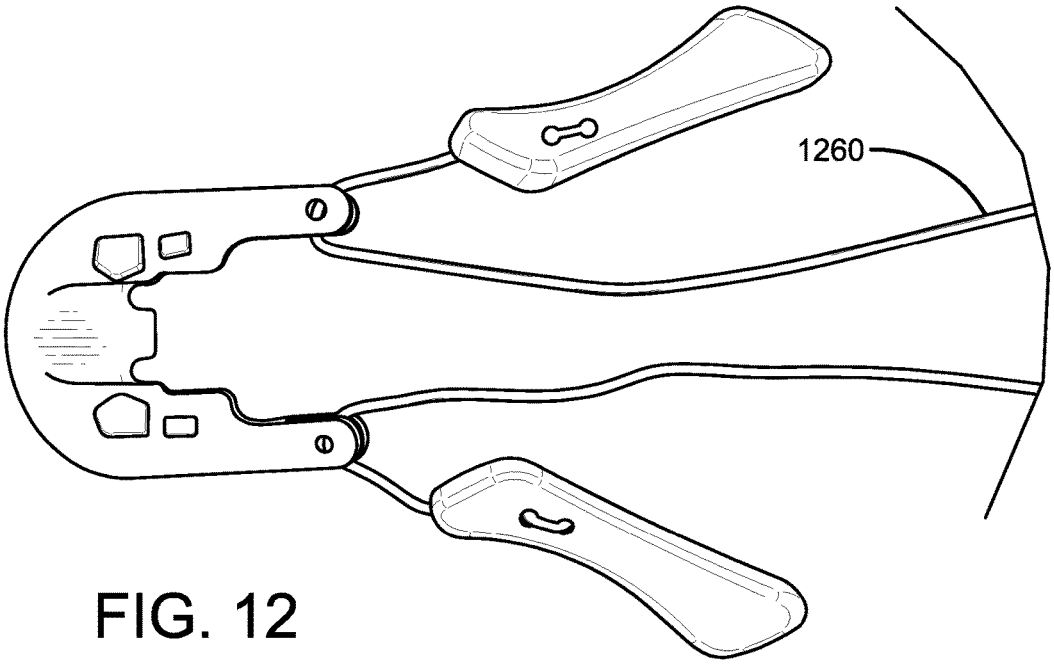
FIG. 12 is a view of one embodiment of a crossbow cocking system.
Figure 13:
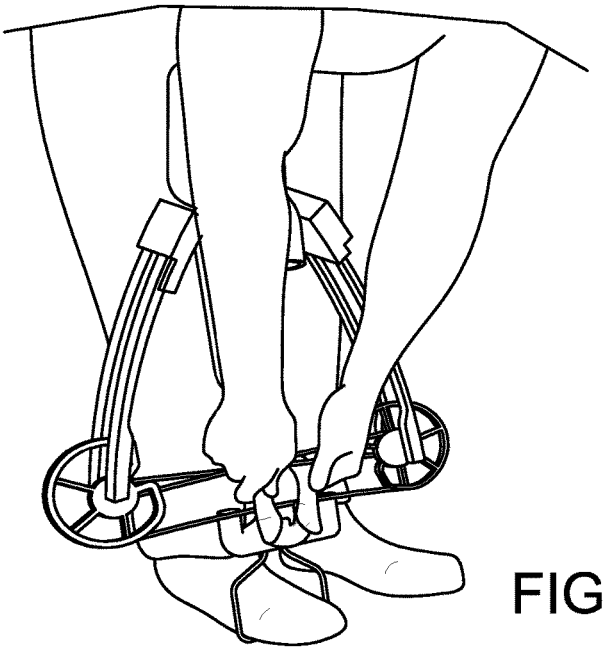
FIG. 13 is a picture of a crossbow being cocked by a user.
Figure 14:
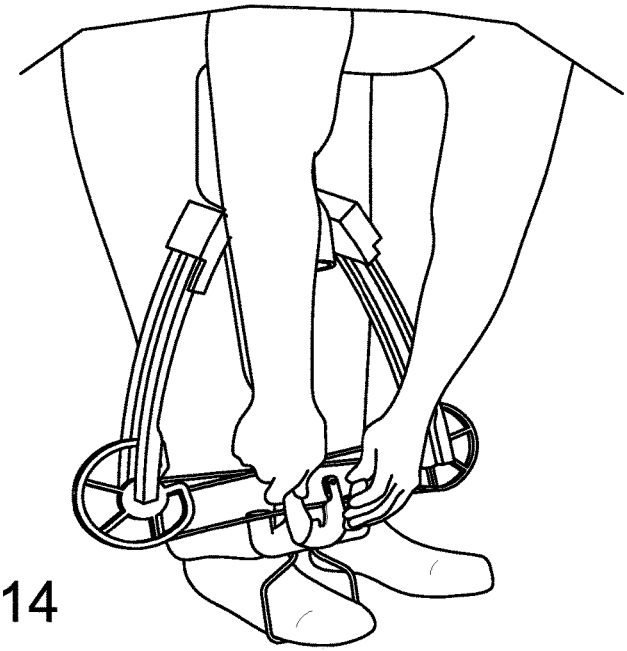
FIG. 14 is a picture of a crossbow being cocked by a user.
Figure 15:
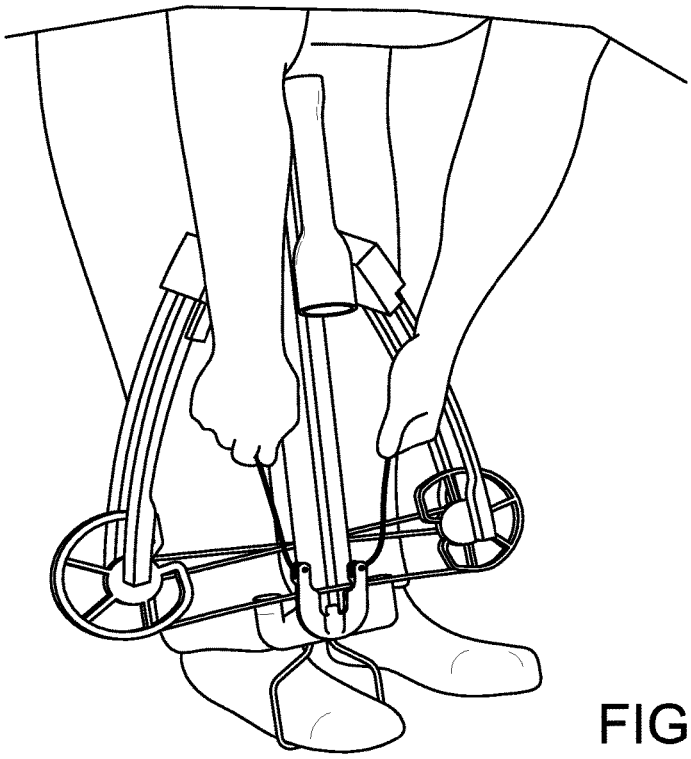
FIG. 15 is a picture of a crossbow being cocked by a user.
Figure 16:
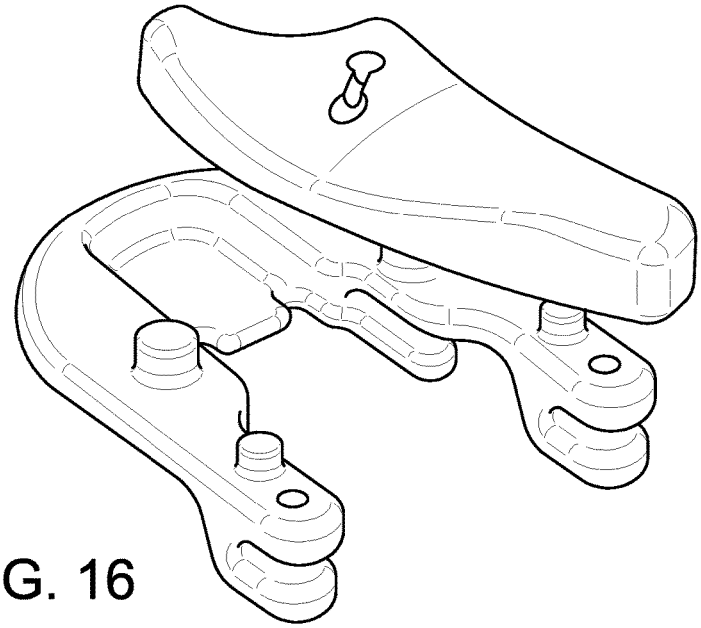
FIG. 16 is a perspective view of one embodiment of a crossbow cocking system.
Figure 17:
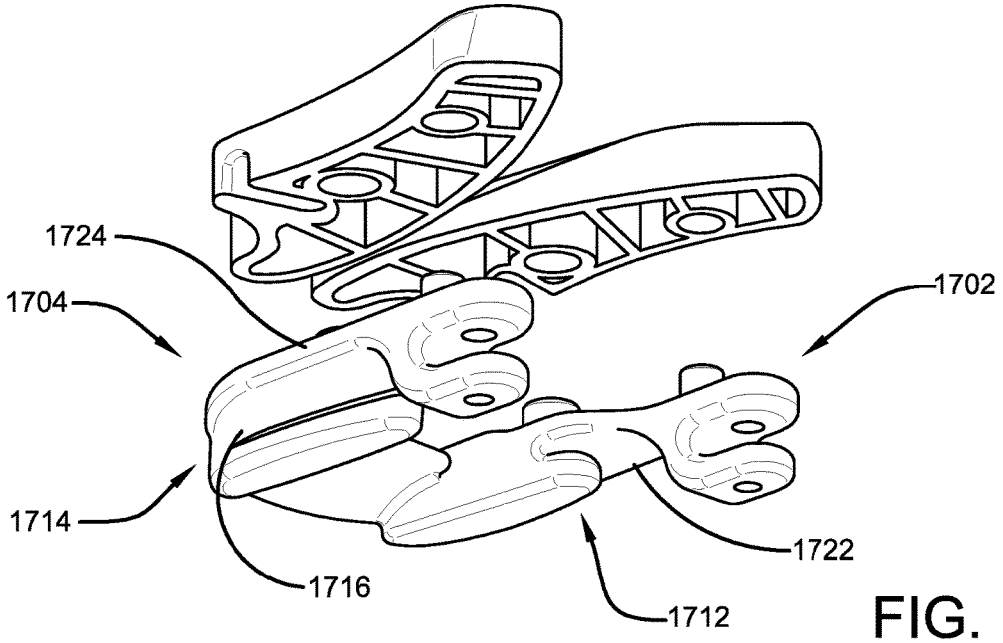
FIG. 17 is a perspective exploded view of one embodiment of a crossbow cocking system.
Figure 18:
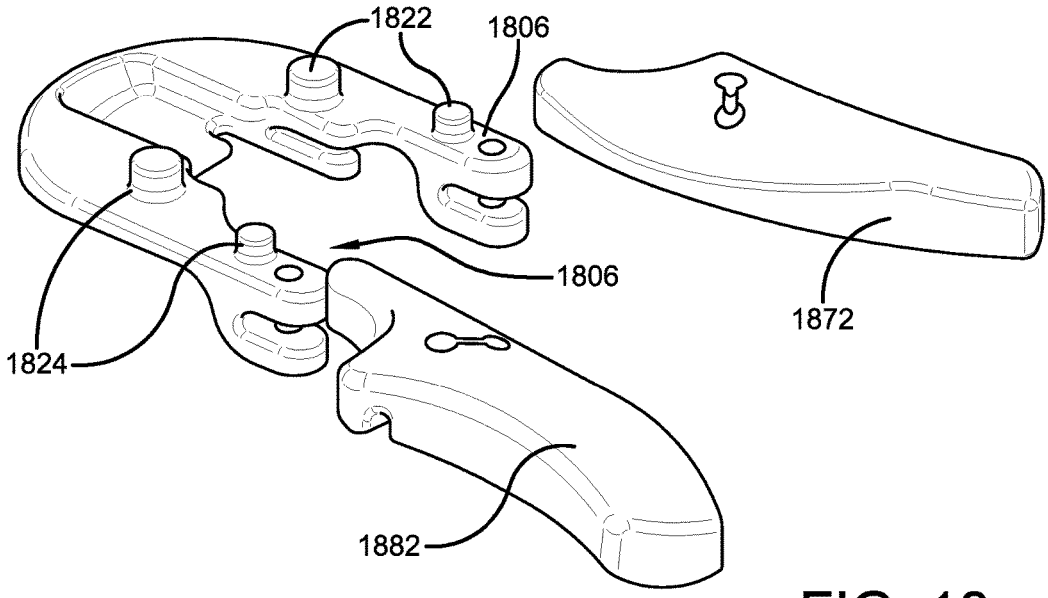
FIG. 18 is a perspective exploded view of one embodiment of a crossbow cocking system.
Figure 19:
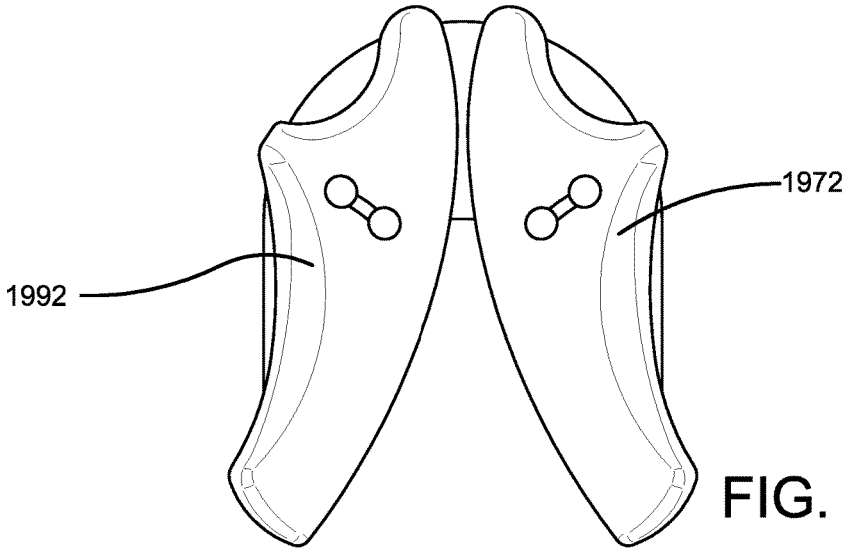
FIG. 19 is a perspective view of one embodiment of a crossbow cocking system.
Figure 20:
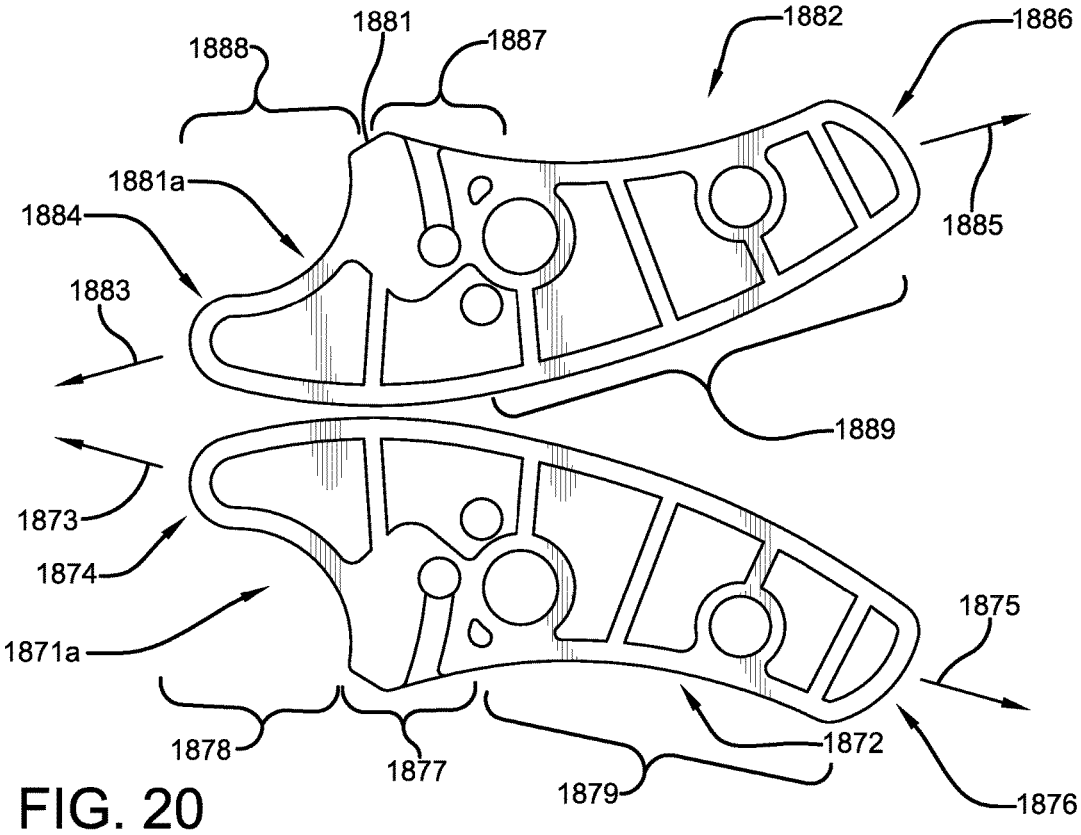
FIG. 20 is a view of one embodiment of the underside of the handles of a crossbow cocking system.
Figure 21:
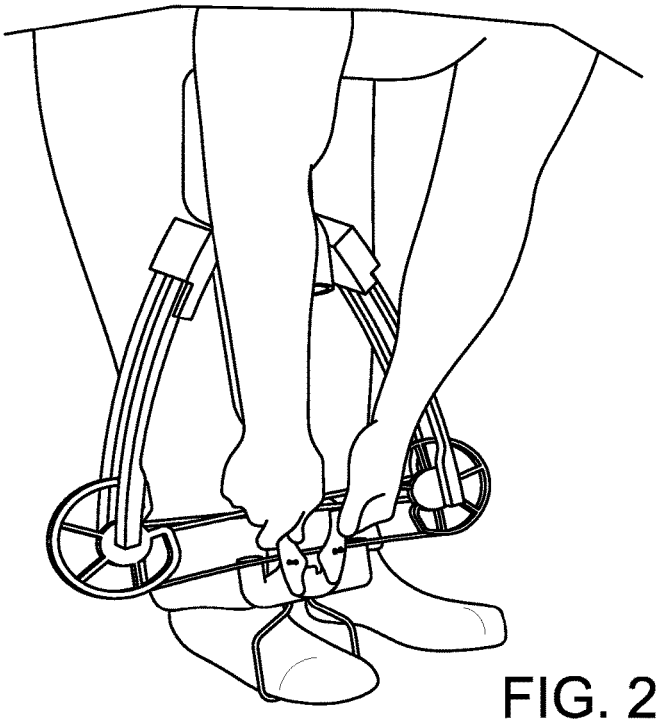
FIG. 21 is a picture of a crossbow being cocked by a user.
Figure 22:
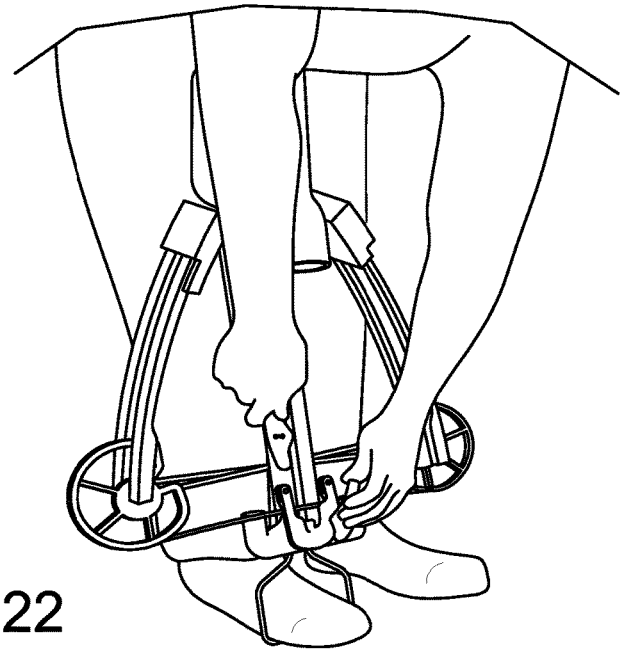
FIG. 22 is a picture of a crossbow being cocked by a user.
Figure 23:
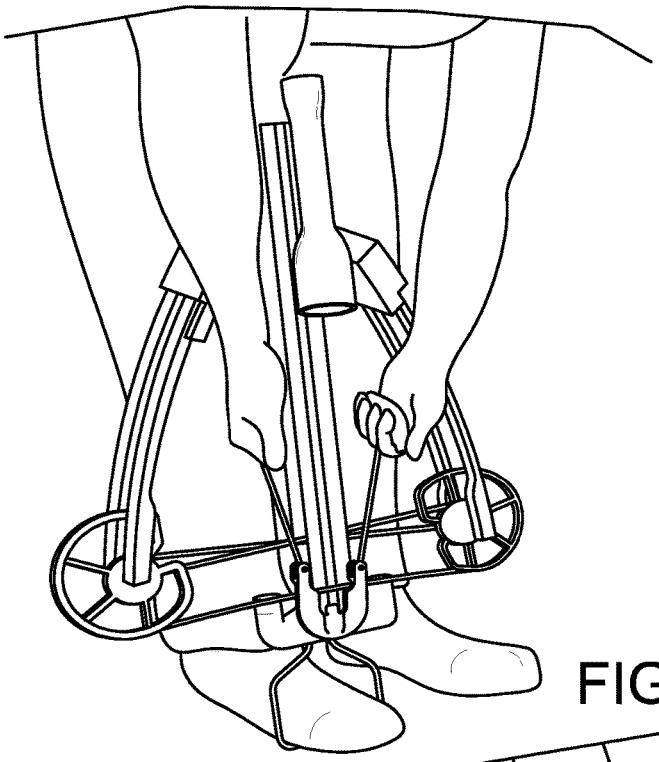
FIG. 23 is a picture of a crossbow being cocked by a user.
Figure 24:
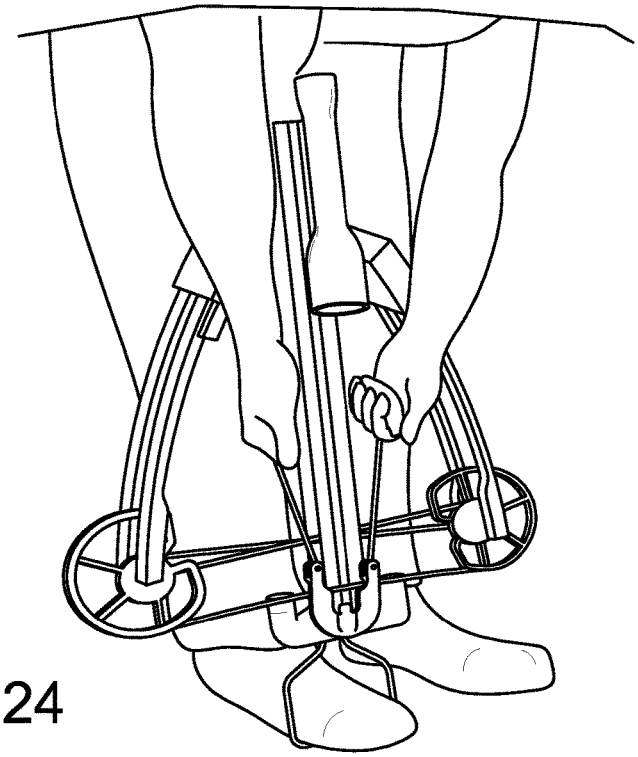
FIG. 24 is a picture of a crossbow being cocked by a user.
Figure 25:
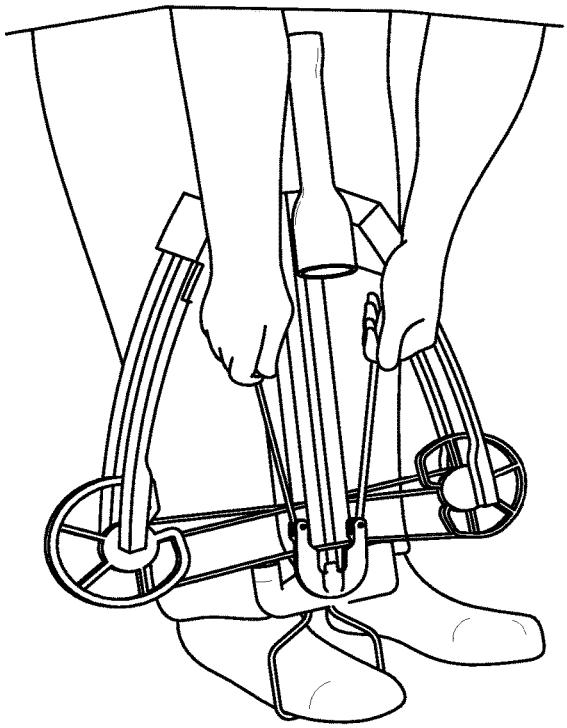
FIG. 25 is a picture of a crossbow being cocked by a user.
Figure 26:
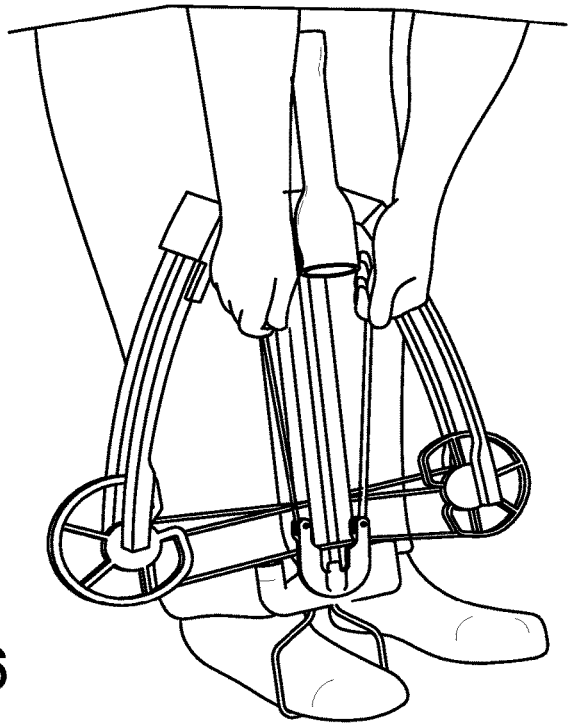
FIG. 26 is a picture of a crossbow being cocked by a user.
Figure 27:
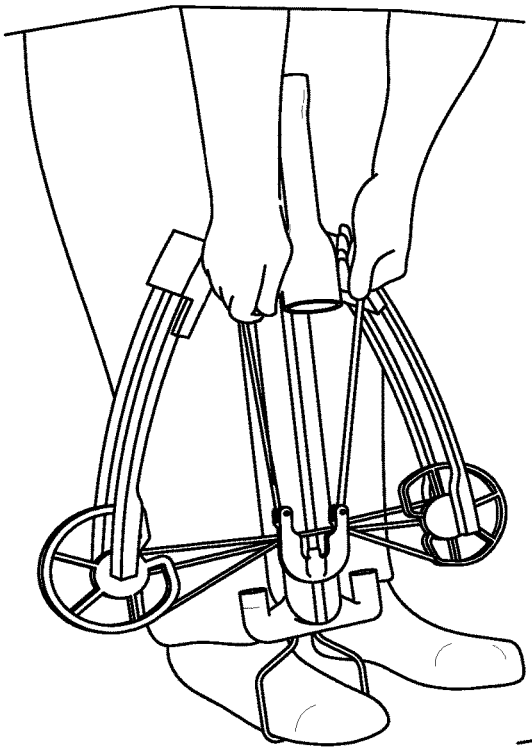
FIG. 27 is a picture of a crossbow being cocked by a user.
Figure 28:
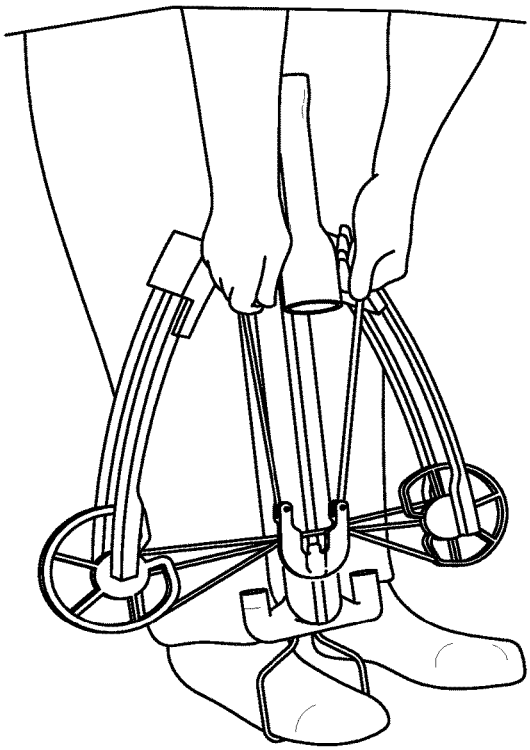
FIG. 28 is a picture of a crossbow being cocked by a user.
Figure 29:
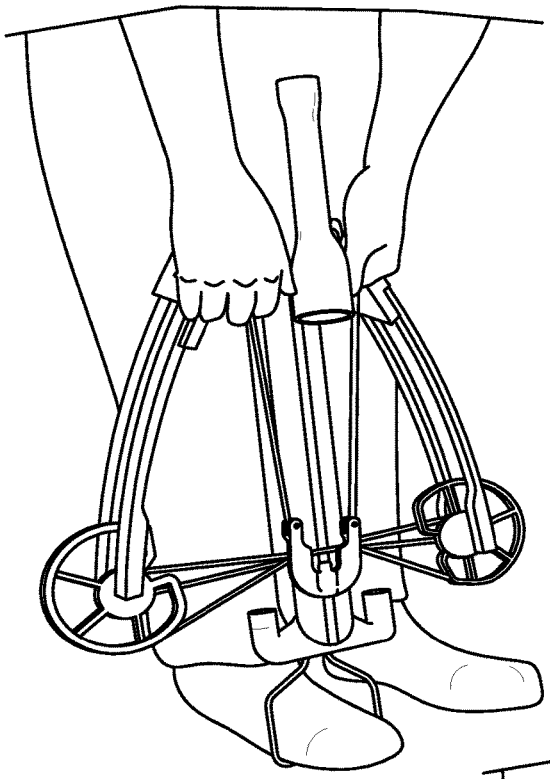
FIG. 29 is a picture of a crossbow being cocked by a user.
Figure 30:
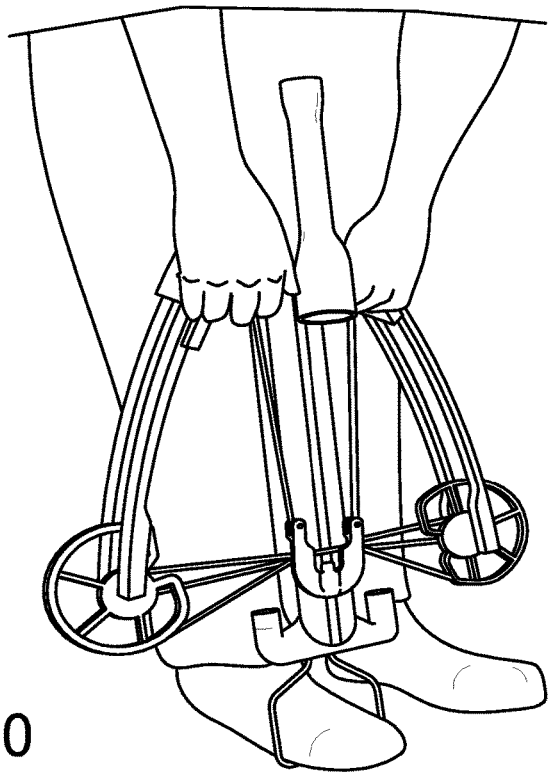
FIG. 30 is a picture of a crossbow being cocked by a user.
Figure 31:
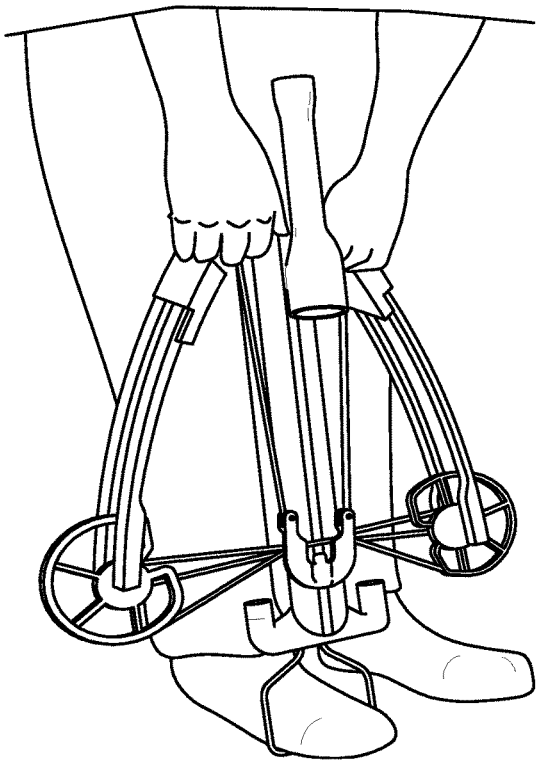
FIG. 31 is a picture of a crossbow being cocked by a user.
Figure 32:
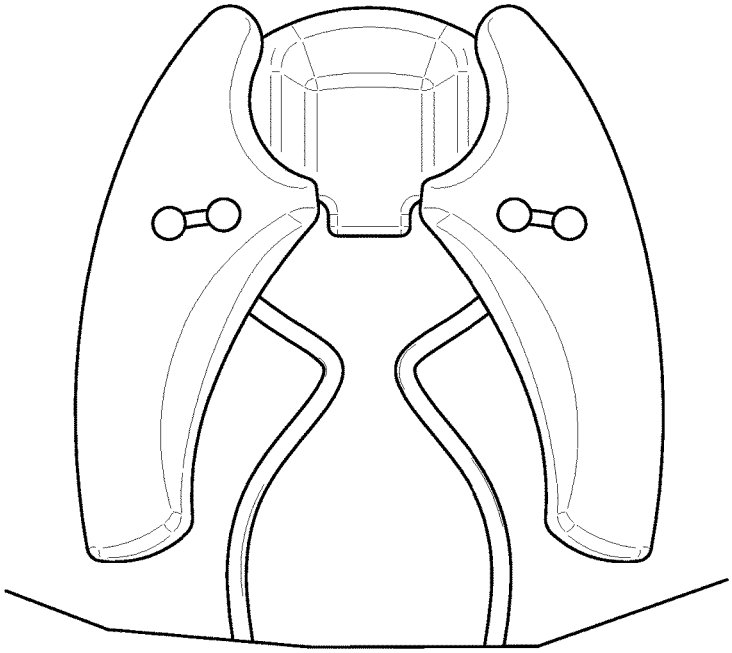
FIG. 32 is a perspective view of one embodiment of a crossbow cocking system.
Figure 33:
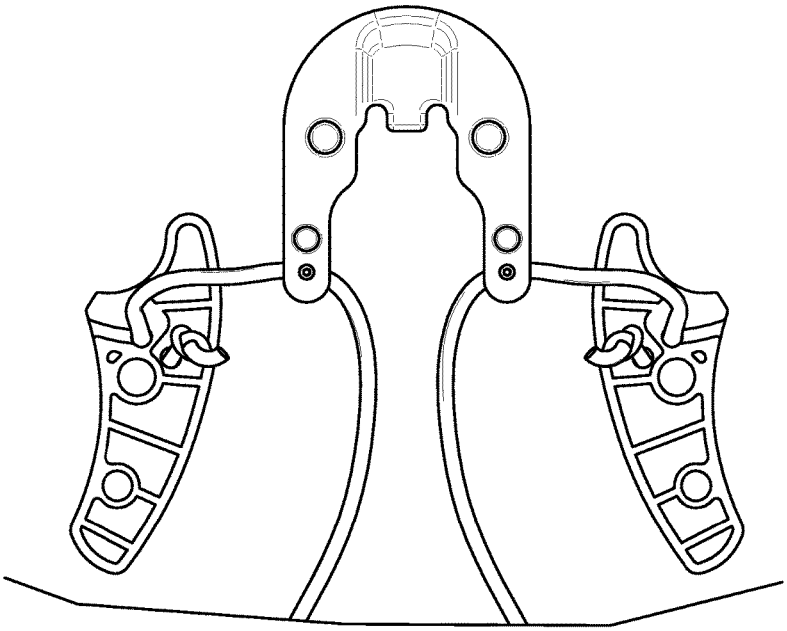
FIG. 33 is a perspective exploded view of one embodiment of a crossbow cocking system.

Referring now to the drawings wherein the showings are for purposes of illustrating embodiments of the present subject matter only and not for purposes of limiting the same, and wherein like reference numerals are understood to refer to like components, provided is a crossbow cocking system 600 and a method for using same. A crossbow cocking system 600 is device adapted to be used by an associated user 610 on an associated crossbow 620 to cock the associated crossbow 620 using one or more hands 612, 614 of the associated user 610.

In some non-limiting embodiment, a crossbow cocking system 600 may comprise a sled 100, an elongated cocking cable 1260, a first handle 870, and a second handle 880. It is contemplated that the first handle may take a variety of forms. First handle 870 is just one acceptable non-limiting form and other acceptable non-limiting forms are described below. It is contemplated that the second handle may take a variety of forms. Second handle 880 is just one acceptable non-limiting form and other acceptable non-limiting forms are described below.

A sled 100 may have a first side 1702, and a second side 1704 opposite the first side 1702 and offset from the first side 1702 by a sled gap 1806. The first side 1702 may have a first bowstring retainer 1712, and a first arm 1722 having a first set of handle engagement features 1822 adapted for engagement with a first handle 870. The first bowstring retainer 1712 may have or define a groove or other similar feature adapted to retain an associated bowstring 242 of an associated crossbow 620 during a cocking operation. The first side 1702 may have a first pulley 3728 rotatably engaged with the first arm 1722. The second side 1704 may have a second bowstring retainer 1714, and a second arm 1724 having a second set of handle engagement features 1824 adapted for engagement with a second handle 880. The second bowstring retainer 1714 may have or define a groove 1716 or other similar feature adapted to retain an associated bowstring 242 of an associated crossbow 620 during a cocking operation. It should be noted that, in some embodiments, the groove 1716 on the second bowstring retainer 1714 may be substantially symmetric across the sled gap 1806 with the groove on the first bowstring retainer 1712. The second side 1704 may have a second pulley 3729 rotatably engaged with the second arm 1724. In some embodiments, the first arm 1722 and the second arm may be substantially linear components parallel to one another, but this is not limiting: it is within the scope of the present subject matter for the sides 1702, 1704 to be angled with respect to one another, or to be curved members where the curvature is described by a planar curve or a three dimensional curve. It should be understood that the handle engagement features 1822, 1824 may be studs adapted to engage counterpart components in the handles by friction forces, they may also comprise magnets adapted to engage ferrous or magnetic counterpart components in the handles by magnetic forces, or a ball and detent set, or otherwise as chosen with good engineering judgment.

The sled gap 1806 may be of sufficient width to accommodate fitting around an associated trigger assembly of an associated crossbow. This accommodation to fit around an associated trigger assembly, may permit the an associated bowstring to be cocked by the sled 100 to some distance in the associated trigger assembly without interfering with or hitting the associated trigger assembly during a cocking operation.

The elongated cocking cable 1260 may have a first end 1262, and a second end 1264 opposite the first end 1262. The elongated cocking cable may comprise a rope, cord, cable, or other elongated flexible component chosen with good engineering judgment. Without limitation, the elongated cocking cable may comprise linen, cotton, coir, jute, straw, sisal, polypropylene, nylon, polyester, polyethylene, aramid, acrylic, or some combination thereof. The elongated cocking cable 1260 is engaged at the first end 1262 to a first handle 870, at the second end 1264 to a second handle 880, and extends through the sled 100.

The first handle 870 may be operationally engaged to the elongated cocking cable 1260 at the first end 1262. The first handle is ergonomically adapted to permit an associated user to operate the first handle during a cocking operation with a first hand in a vertical hand position. Acceptable non-limiting forms for the first handle 870 include first compact handle 872, first transition handle 1872, a first T-handle 3572, and a first loop handle 4472.

A first compact handle 872 may be elongated to define a first forward direction 873 toward a first handle front 874, and may be elongated to define a first rearward direction 875 toward a first handle back 876 opposite the first handle front 874. A first compact handle 872 may have a first cable engagement region 877 biased toward the first handle front 874 to define a first forward handle region 878 between the first handle front 874 and the first cable engagement region 877 and a first rearward handle region 879 between the first handle back 876 and the first cable engagement region 877. The first forward handle region 878 may increase in cross-sectional area in the first forward direction 873 over at least a portion thereof. The first rearward handle region 879 may increase in cross-sectional area in the first rearward direction 875 over at least a portion thereof.

A first transition handle 1872 may be elongated to define a first forward direction 1873 toward a first handle front 1874 and a first rearward direction 1875 toward a first handle back 1876 opposite the first handle front 1874. A first transition handle 1872 may have a cable engagement region 1877 biased toward the first handle front 1874 to define a first forward handle region 1878 between the first handle front 1874 and the cable engagement region 1877, a first rearward handle region 1879 between the first handle back 1876 and the cable engagement region 1877, and a spur 1871 or projection extending from the handle 1872 between the first forward handle region 1878 and the first rearward handle region 1879. In some non-limiting embodiments, the first forward handle region 1878 may have a convex finger receptacle 1871*a* adjacent to and partially defined by the spur 1871.

Figure 34:
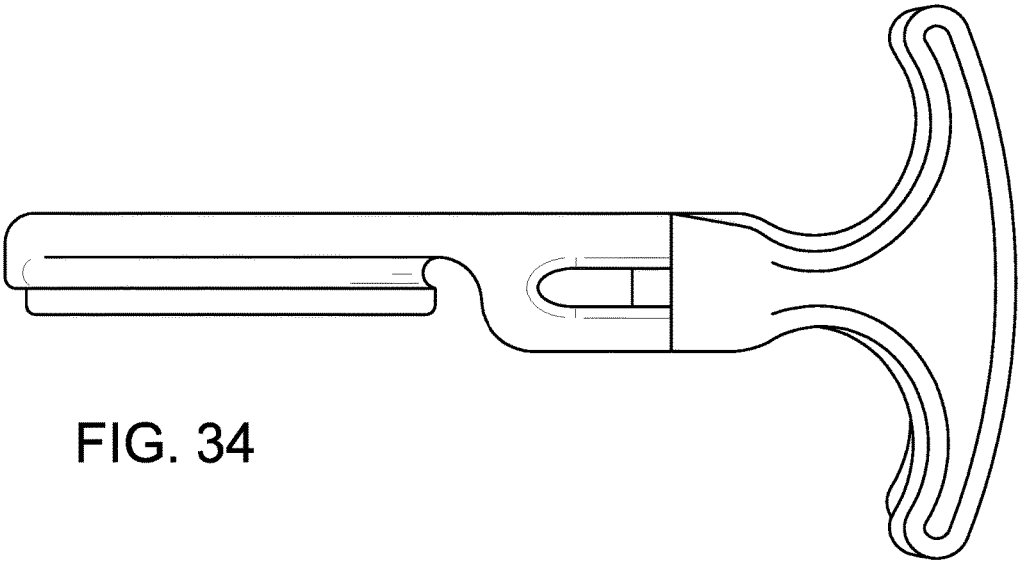
FIG. 34 is a perspective view of one embodiment of a crossbow cocking system.
Figure 35:
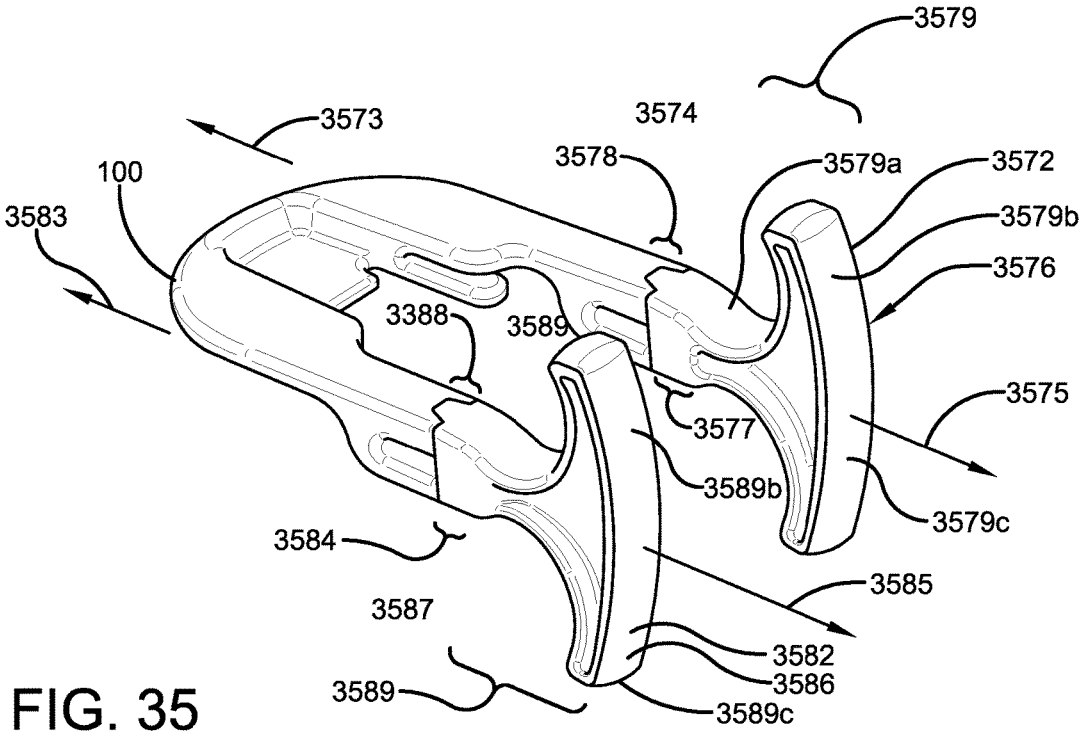
FIG. 35 is a perspective view of one embodiment of a crossbow cocking system.
Figure 36:
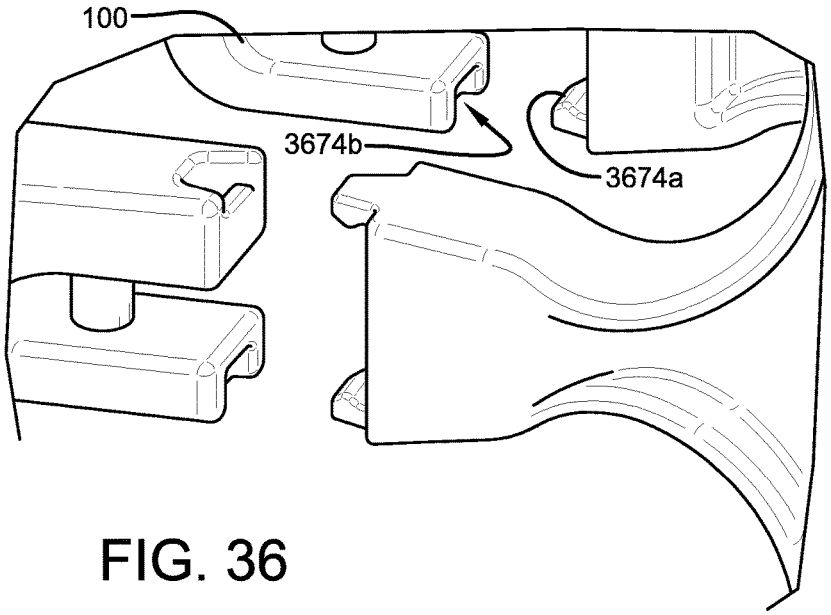
FIG. 36 is a close up perspective view of one embodiment of a crossbow cocking system.
Figure 37:
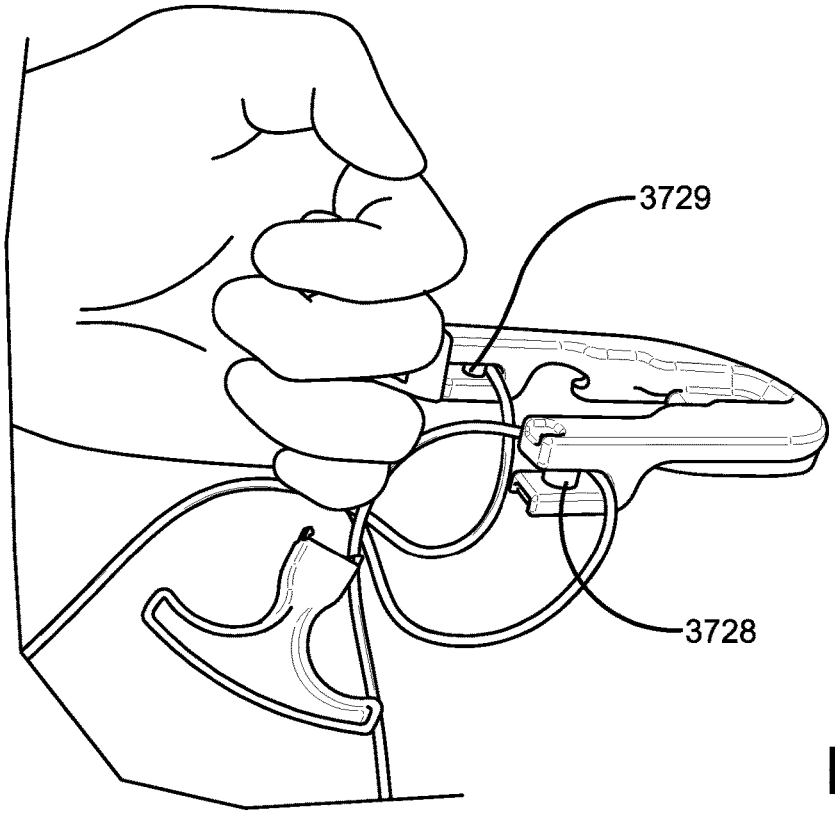
FIG. 37 is a picture of a user grasping by hand one handle of one embodiment of a crossbow cocking system.
Figure 38:
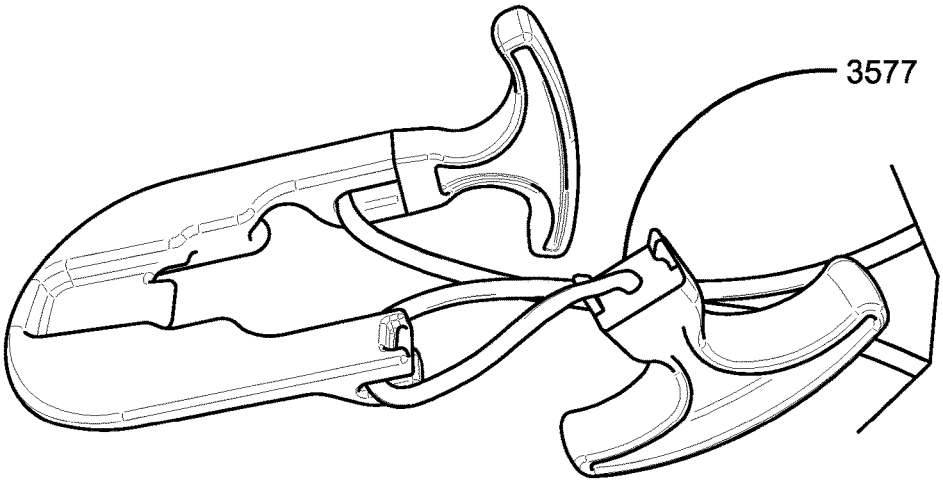
FIG. 38 is a picture of one embodiment of a crossbow cocking system with a first handle in snap fit engagement with the sled and a second handle disengaged from the sled.
Figure 39:
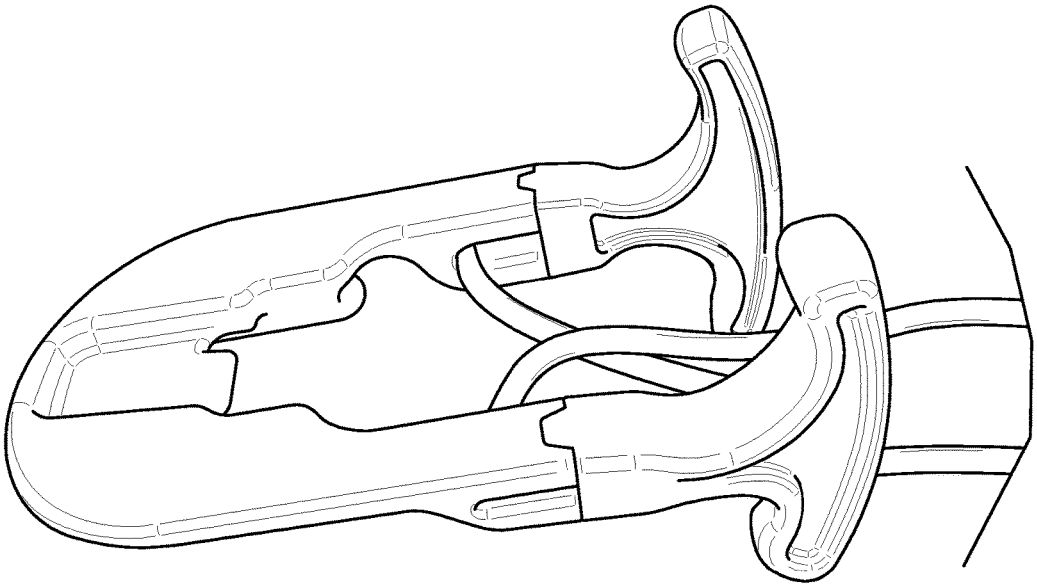
FIG. 39 is a perspective view of one embodiment of a crossbow cocking system.
Figure 40:
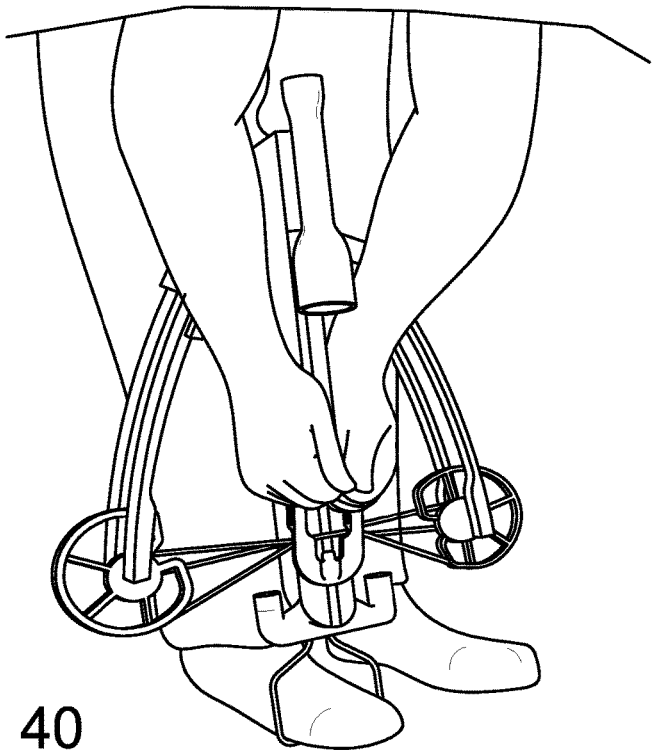
FIG. 40 is a picture of a crossbow being cocked by a user.
Figure 41:
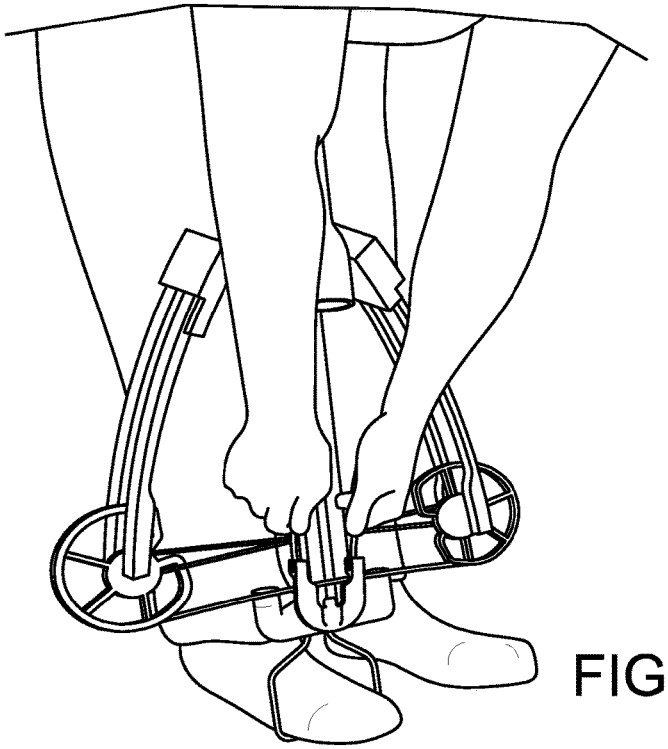
FIG. 41 is a picture of a crossbow being cocked by a user.
Figure 42:
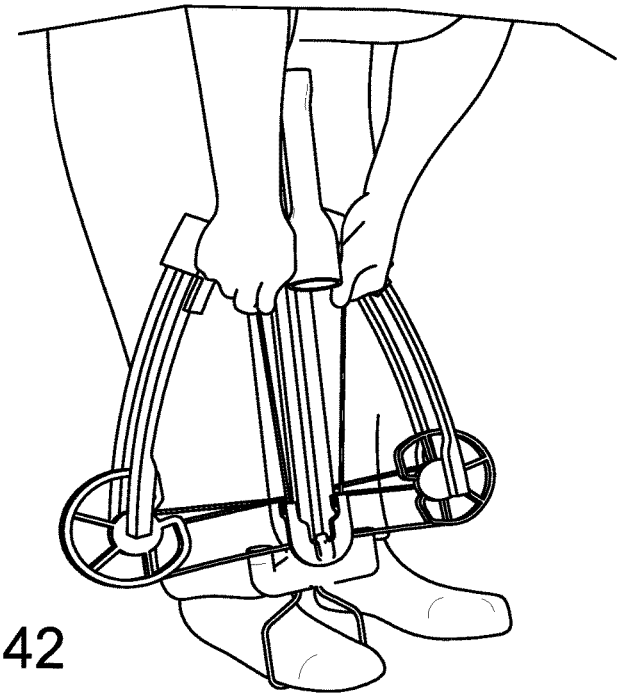
FIG. 42 is a picture of a crossbow being cocked by a user.
Figure 43:
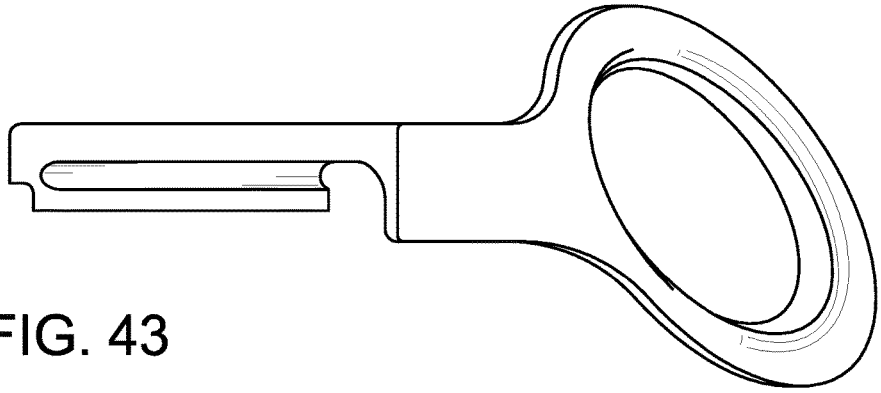
FIG. 43 is a perspective view of one embodiment of a crossbow cocking system.
Figure 44:
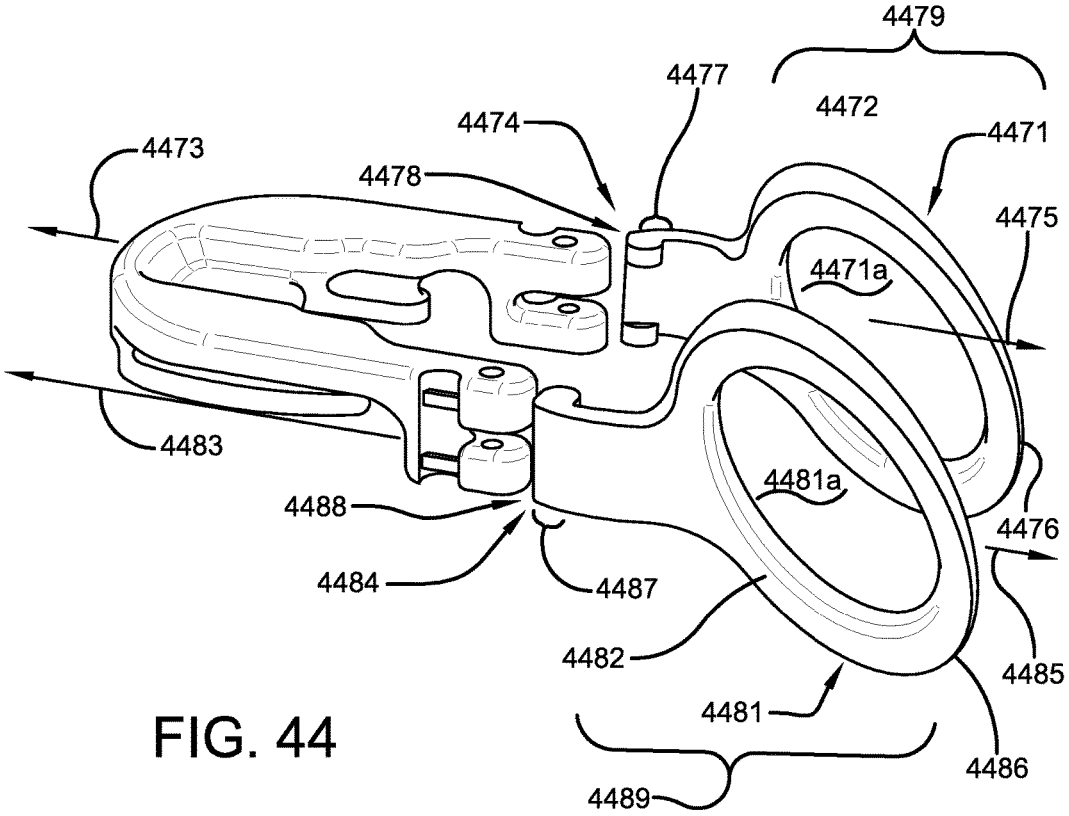
FIG. 44 is a perspective exploded view of one embodiment of a crossbow cocking system.
Figure 45:
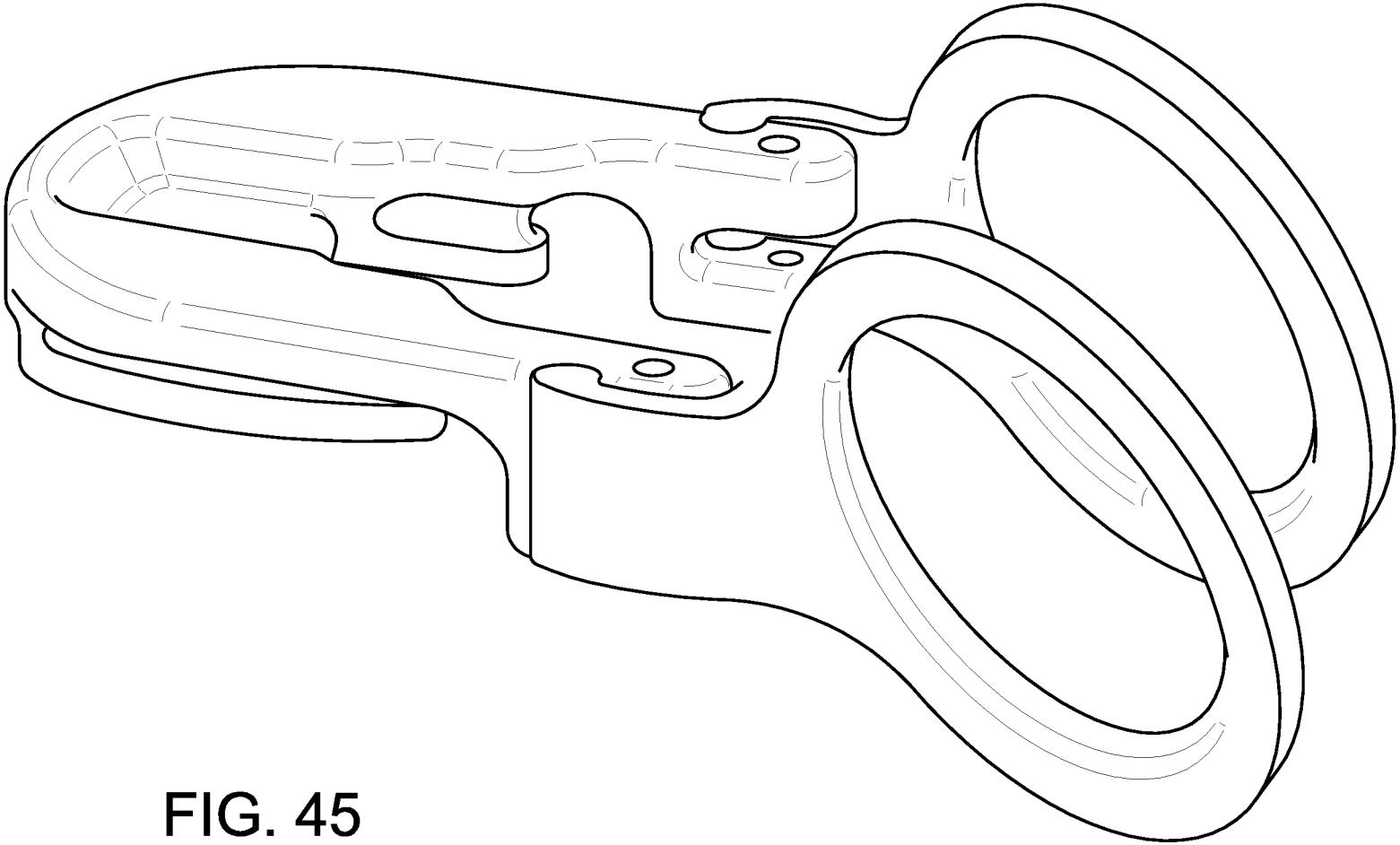
FIG. 45 is a perspective view of one embodiment of a crossbow cocking system.
Figure 46:
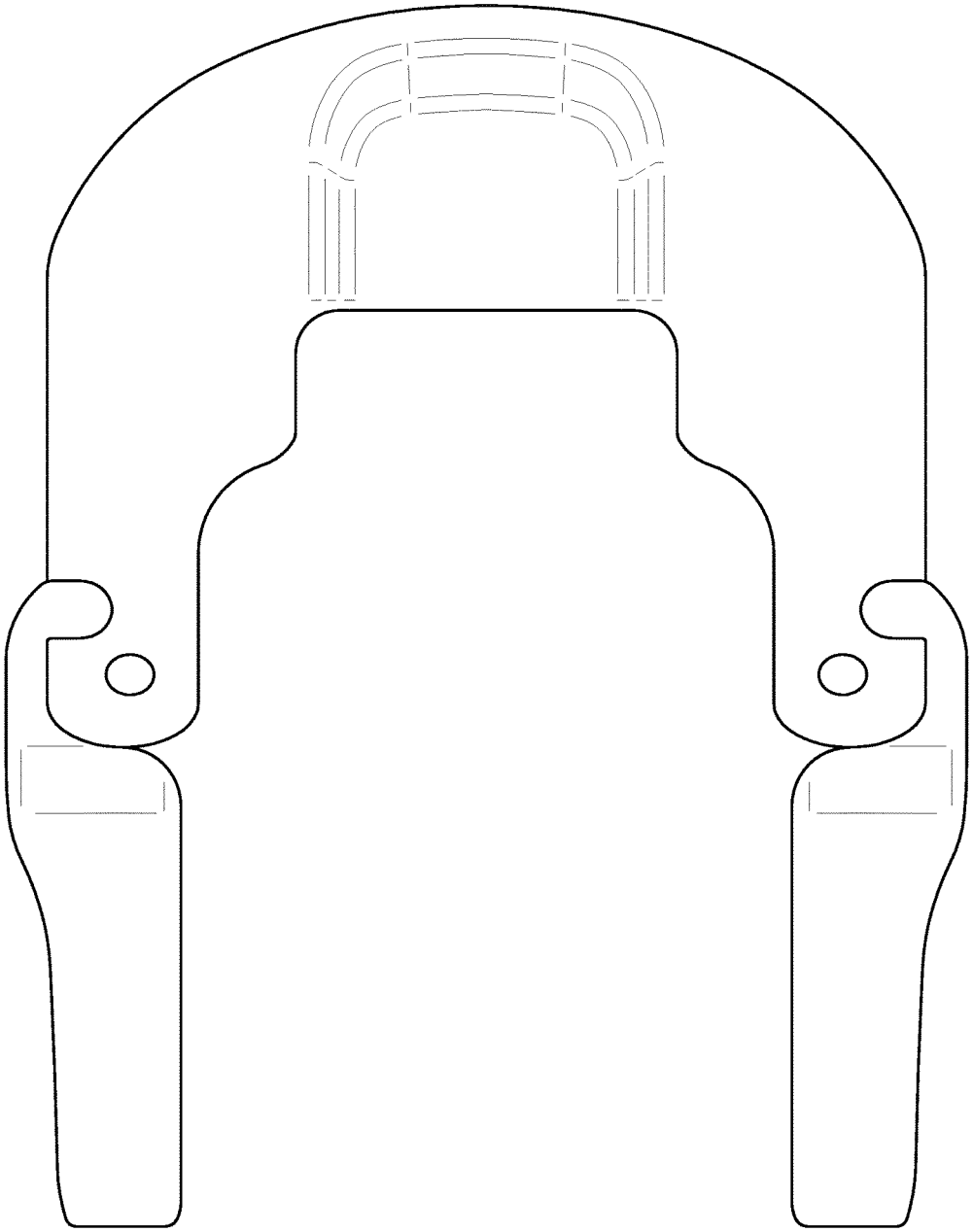
FIG. 46 is a perspective view of one embodiment of a crossbow cocking system.
Figure 47:
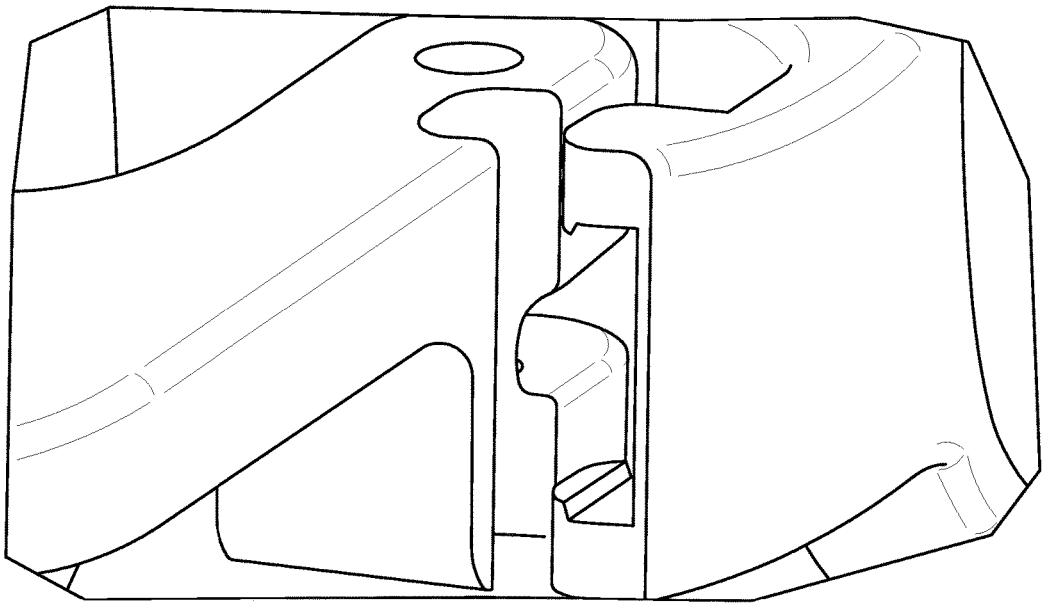
FIG. 47 is a close up perspective view of one embodiment of a crossbow cocking system.
Figure 48:
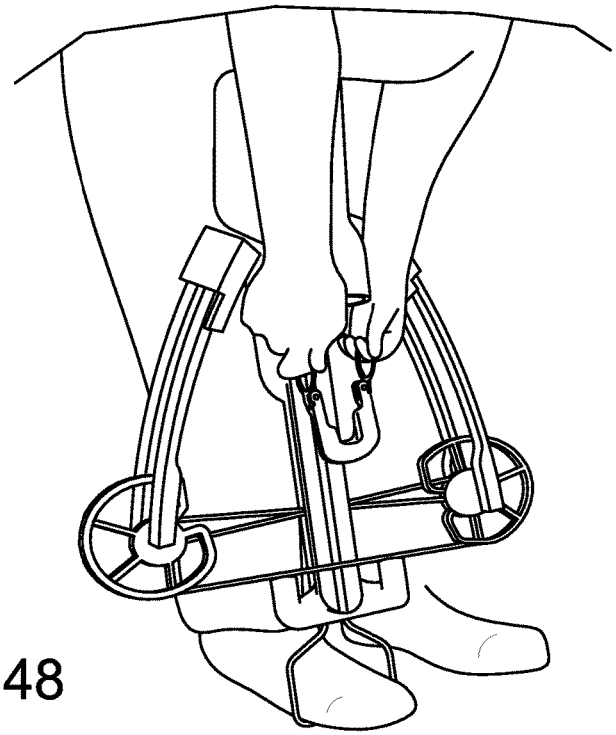
FIG. 48 is a picture of a crossbow being cocked by a user.
Figure 49:
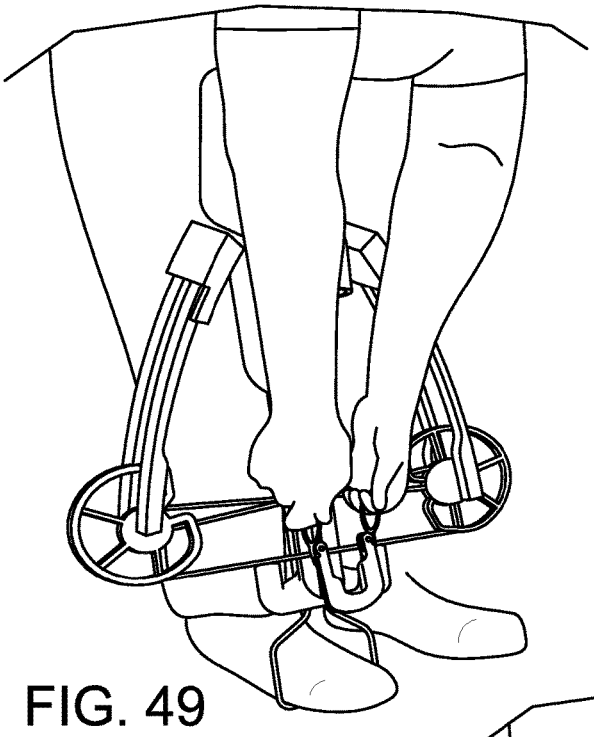
FIG. 49 is a picture of a crossbow being cocked by a user.
Figure 50:
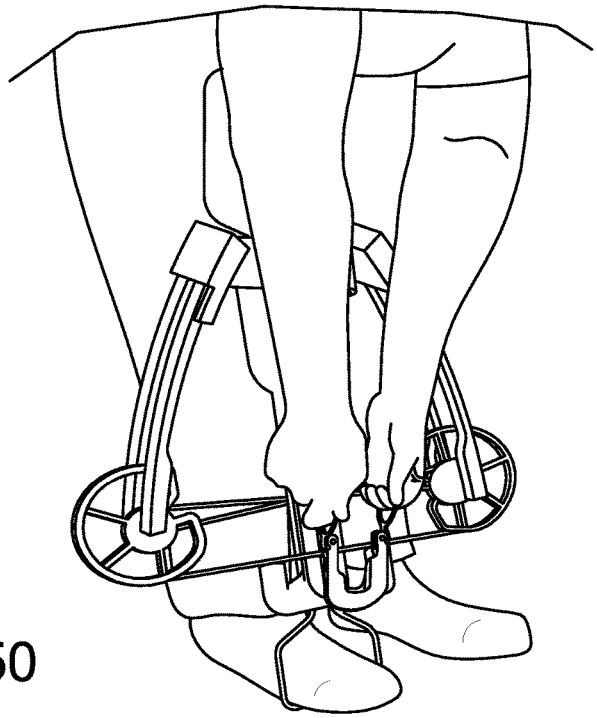
FIG. 50 is a picture of a crossbow being cocked by a user.
Figure 51:
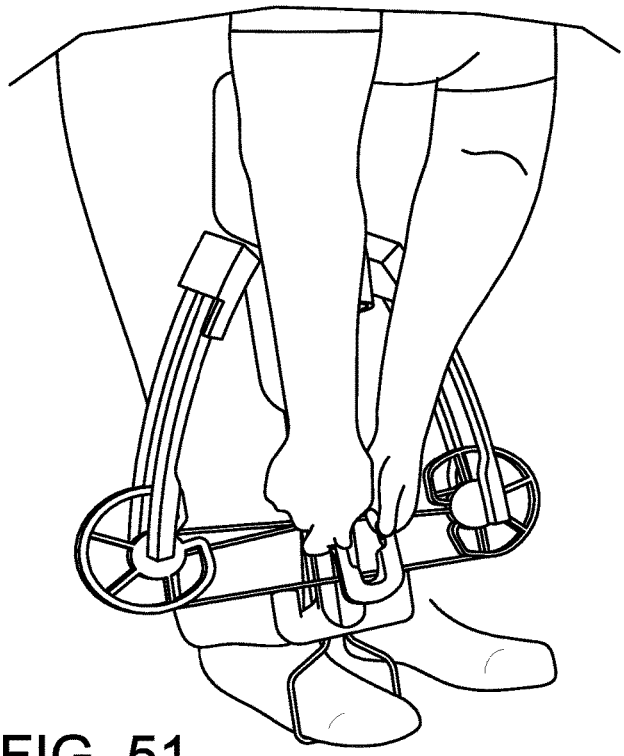
FIG. 51 is a picture of a crossbow being cocked by a user.
Figure 52:
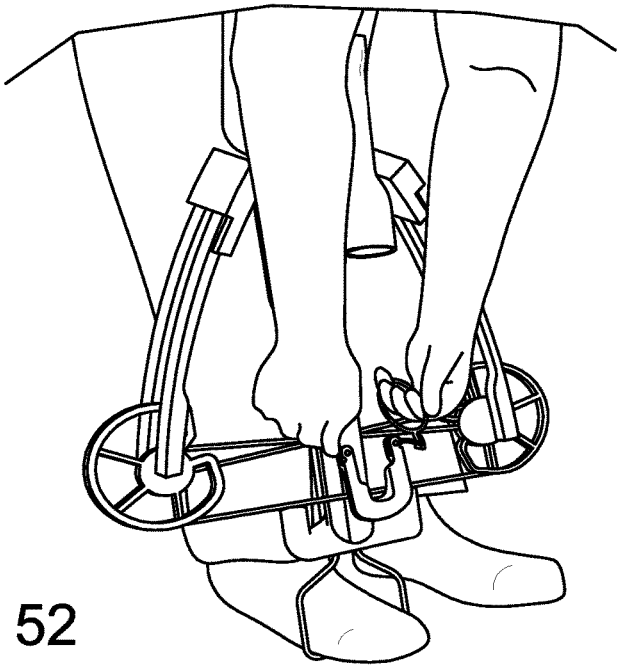
FIG. 52 is a picture of a crossbow being cocked by a user.
Figure 53:
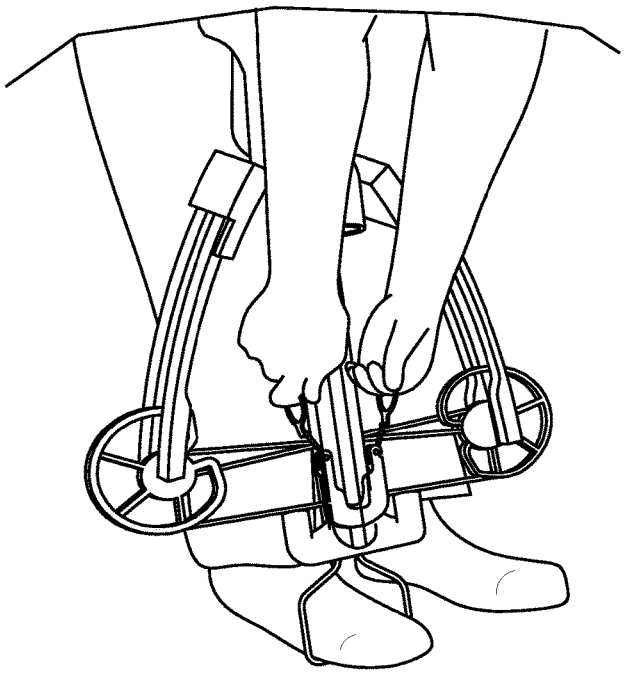
FIG. 53 is a picture of a crossbow being cocked by a user.
Figure 54:
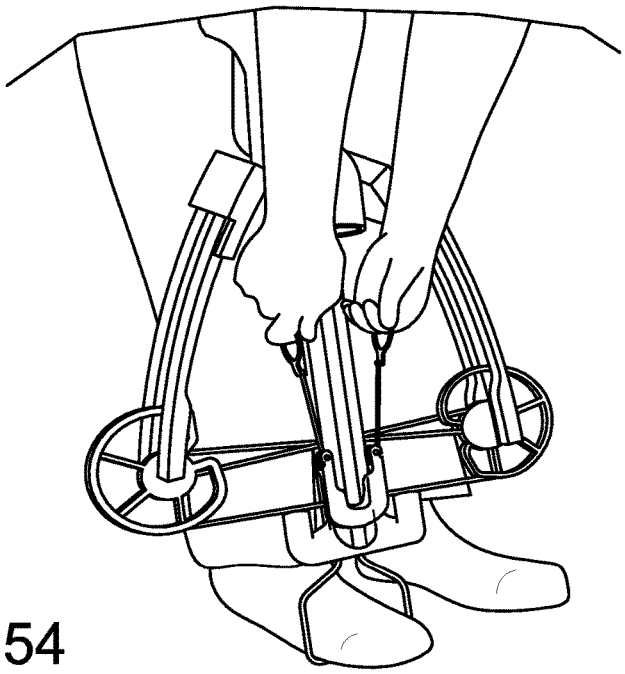
FIG. 54 is a picture of a crossbow being cocked by a user.
Figure 55:
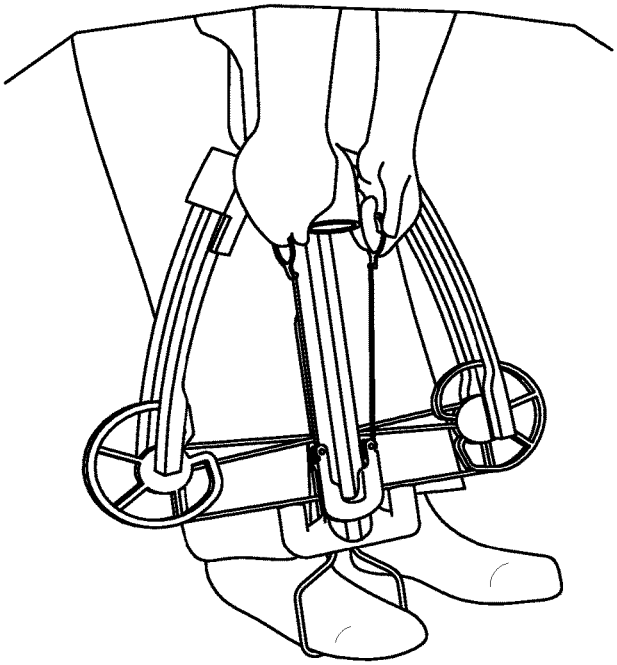
FIG. 55 is a picture of a crossbow being cocked by a user.
Figure 56:
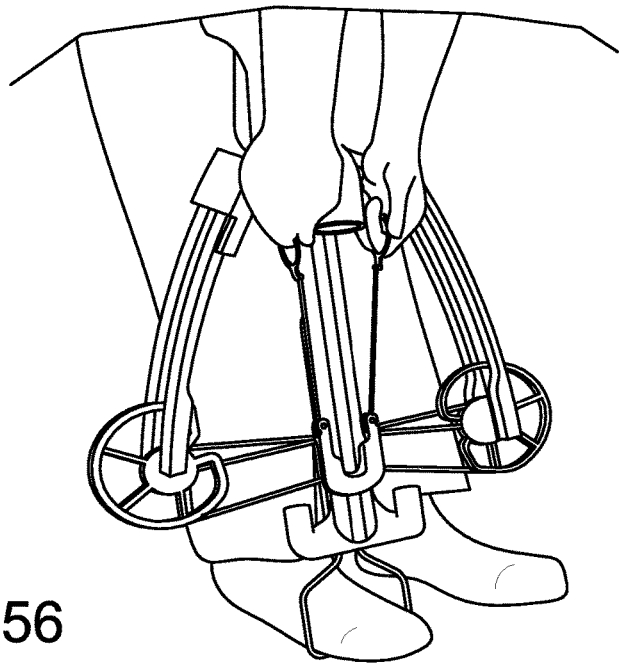
FIG. 56 is a picture of a crossbow being cocked by a user.
Figure 57:
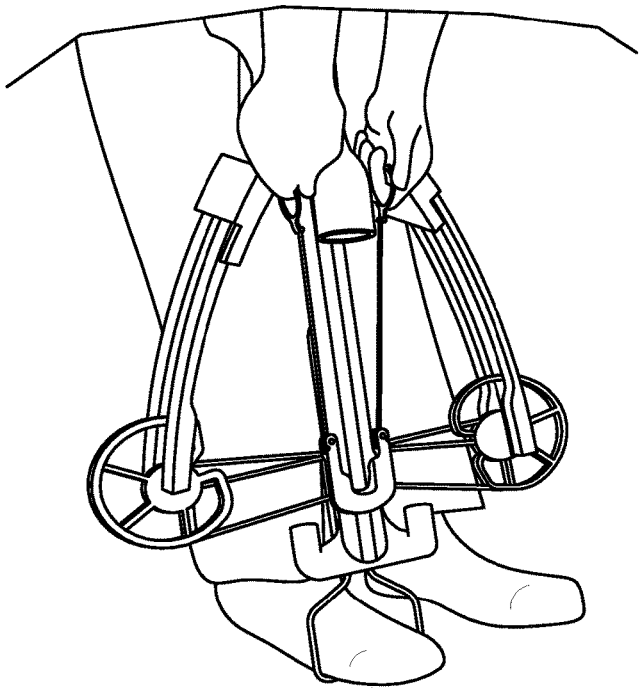
FIG. 57 is a picture of a crossbow being cocked by a user.
Figure 58:
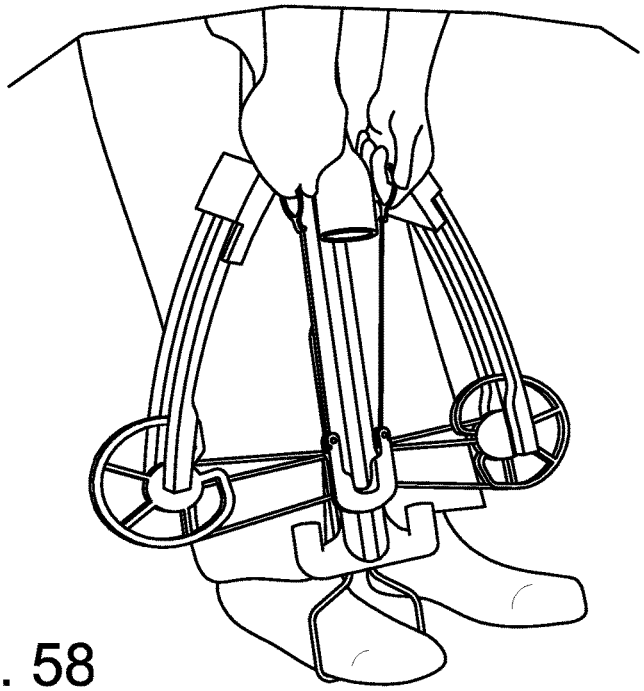
FIG. 58 is a picture of a crossbow being cocked by a user.
Figure 59:
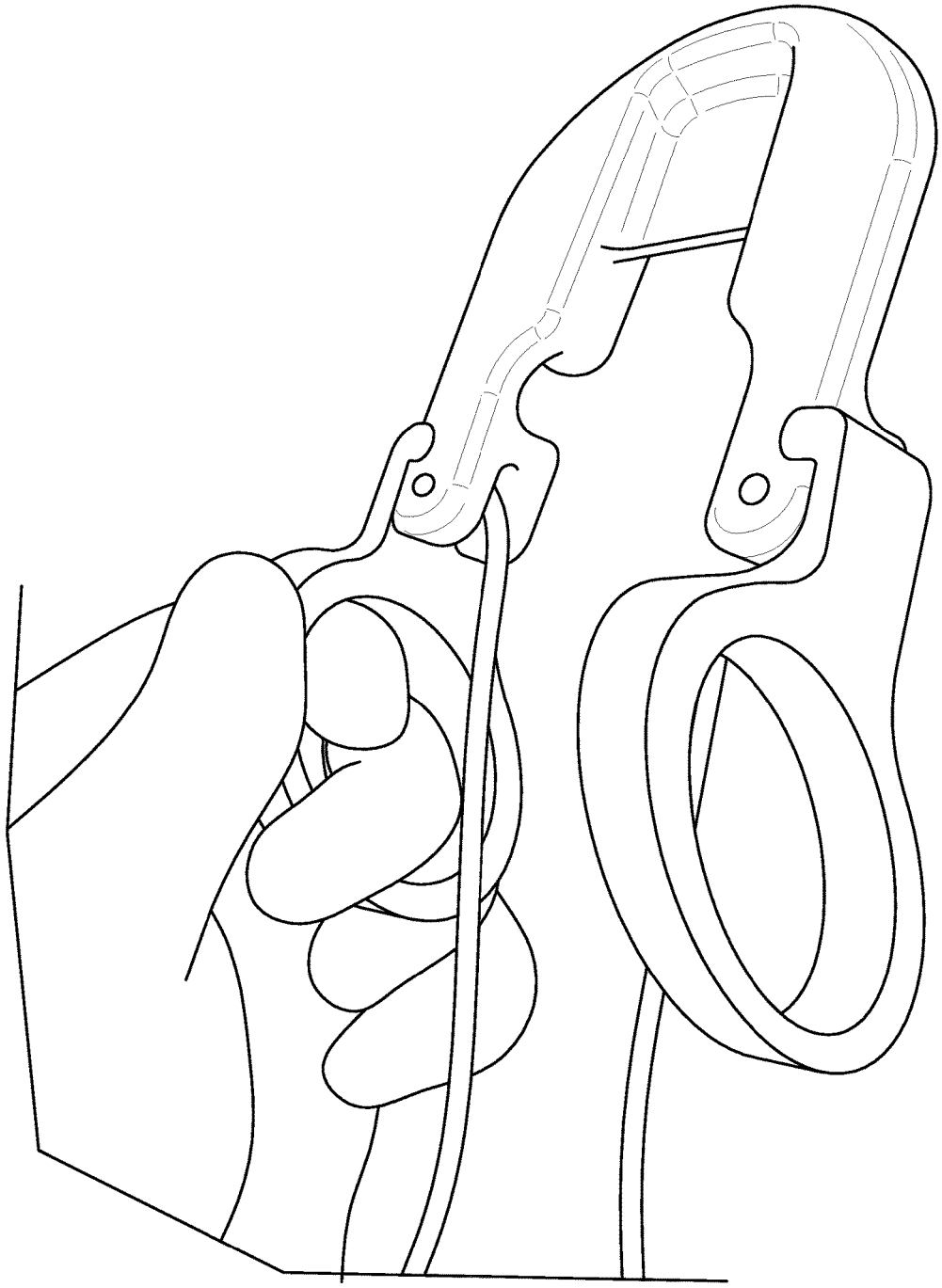
FIG. 59 is a picture of a user grasping by hand one handle of one embodiment of a crossbow cocking system.
Figure 60:
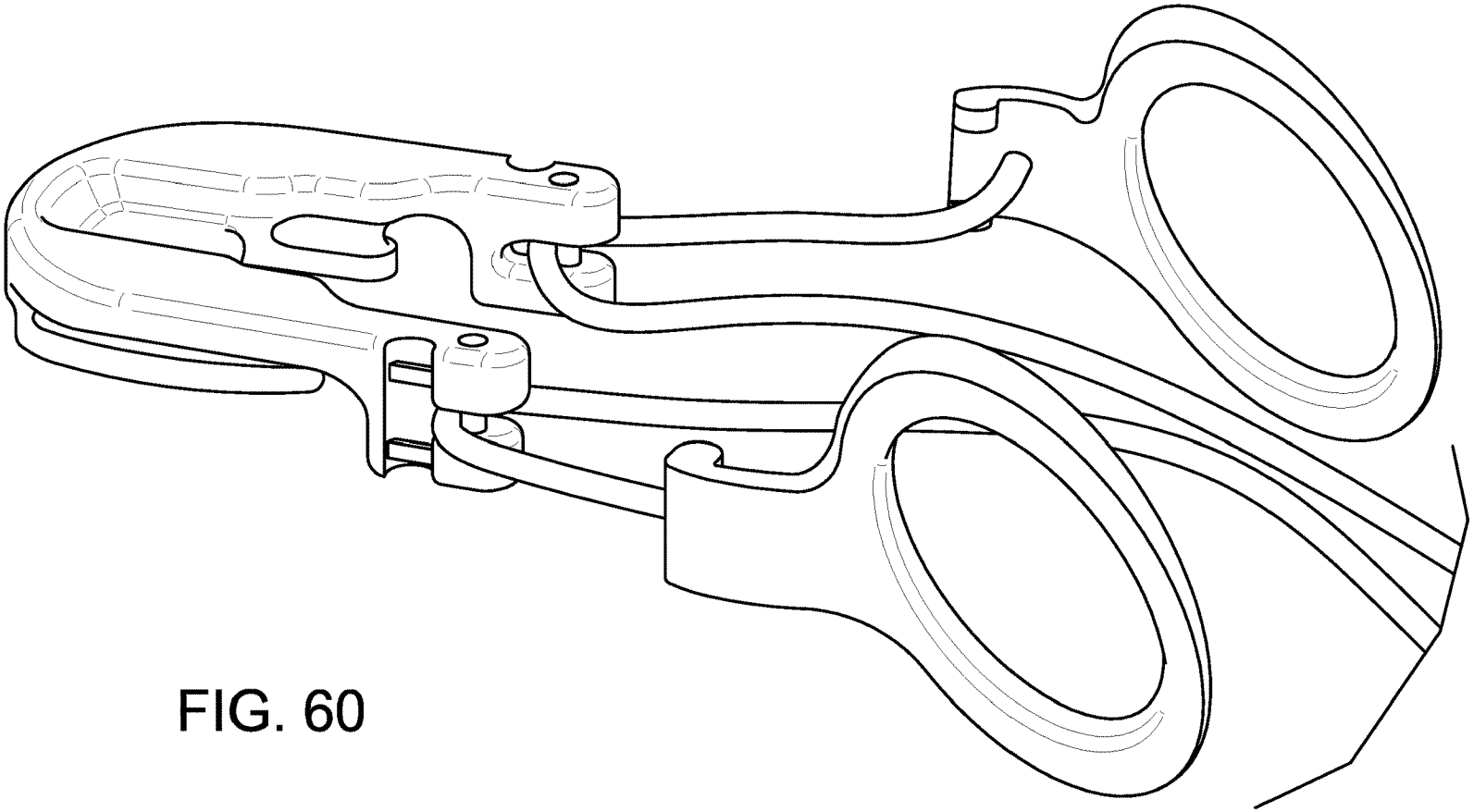
FIG. 60 is a perspective view of one embodiment of a crossbow cocking system.

A first T-handle 3572 may be elongated to define a first forward direction 3573 toward a first handle front 3574 and a first rearward direction 3575 toward a first handle back 3576 opposite the first handle front 3574. A first T-handle 3572 may have a cable engagement region 3577 biased toward the first handle front 3574 to define a first forward handle region 3578 between the first handle front 3574 and the cable engagement region 3577. The first handle front 3574 may have one or more snap components 3674*a* adapted for snap fit engagement with one or more counterpart snap components 3674*b* on the sled 100. A first T-handle 3572 may have a first rearward handle region 3579 between the first handle back 3576 and the cable engagement region 3577. A first rearward handle region 3579 may be T-shaped having a stem 3579*a*, a first cross piece 3579*b* perpendicular to stem 3579*a*, and a second cross piece 3579*c* perpendicular to stem 3579*a*. A T-shaped handle may have the conventional meaning of being shaped like the letter "T". It is contemplated that in some non-limiting embodiments, a T-shaped handle may deviate in some ways from the conventional meaning of being shaped like the letter "T", the cross pieces may be not quite perpendicular to the stem or the cross pieces may be not quite parallel to one another. As shown in FIGS. 34-35, there may some curvature to the cross pieces 3579*b* and 3579*c* in some non-limiting embodiments.

A first loop handle 4472 may be elongated to define a first forward direction 4473 toward a first handle front 4474, and may be elongated to define a first rearward direction 4475 toward a first handle back 4476 opposite the first handle front 4474. A first loop handle 4472 may have a first cable engagement region 4477 biased toward the first handle front 4474 to define a first forward handle region 4478 between the first handle front 4474 and the first cable engagement region 4477 and a first rearward handle region 4479 between the first handle back 4476 and the first cable engagement region 4477. In a first loop handle 4472 the first rearward handle region may have a closed loop 4471 defining a through hole 4471*a*.

The second handle 880 may be operationally engaged to the elongated cocking cable 1260 at the second end 1264. The second handle is ergonomically adapted to permit an associated user to operate the second handle during a cocking operation with a second hand in a vertical hand position. Acceptable non-limiting forms for the second handle 880 include second compact handle 882, second transition handle 1882 a second T-handle 3582, and a second loop handle 4482.

A second compact handle 882 may be elongated to define a first forward direction 883 toward a first handle front 884, and may be elongated to define a first rearward direction 885 toward a first handle back 886 opposite the first handle front 884. A second compact handle 882 may have a first cable engagement region 887 biased toward the first handle front 884 to define a first forward handle region 888 between the first handle front 884 and the first cable engagement region 887 and a first rearward handle region 889 between the first handle back 886 and the first cable engagement region 887. The first forward handle region 888 may increase in cross-sectional area in the first forward direction 883 over at least a portion thereof. The first rearward handle region 889 may increase in cross-sectional area in the first rearward direction 885 over at least a portion thereof.

A second transition handle 1882 may be elongated to define a first forward direction 1883 toward a first handle front 1884 and a first rearward direction 1885 toward a first handle back 1886 opposite the first handle front 1884. A second transition handle 1882 may have a cable engagement region 1887 biased toward the first handle front 1884 to define a first forward handle region 1888 between the first handle front 1884 and the cable engagement region 1887, a first rearward handle region 1889 between the first handle back 1886 and the cable engagement region 1887, and a spur 1881 or projection extending from the handle 1882 between the first forward handle region 1888 and the first rearward handle region 1889. In some non-limiting embodiments, the first forward handle region 1888 may have a convex finger receptacle 1881*a* adjacent to and partially defined by the spur 1881.

A first T-handle 3582 may be elongated to define a first forward direction 3583 toward a first handle front 3584 and a first rearward direction 3585 toward a first handle back 3586 opposite the first handle front 3584. A first T-handle 3582 may have a cable engagement region 3587 biased toward the first handle front 3584 to define a first forward handle region 3588 between the first handle front 3584 and the cable engagement region 3587. The first handle front 3584 may have one or more snap components 3684*a* adapted for snap fit engagement with one or more counterpart snap components 3684*b* on the sled 100. A first T-handle 3582 may have a first rearward handle region 3589 between the first handle back 3586 and the cable engagement region 3587. A first rearward handle region 3589 may be T-shaped having a stem 3589*a*, a first cross piece 3589*b* perpendicular to stem 3589*a*, and a second cross piece 3589*c* perpendicular to stem 3589*a*. A T-shaped handle may have the conventional meaning of being shaped like the letter "T". It is contemplated that in some non-limiting embodiments, a T-shaped handle may deviate in some ways from the conventional meaning of being shaped like the letter "T", the cross pieces may be not quite perpendicular to the stem or the cross pieces may be not quite parallel to one another. As shown in FIGS. 34-35, there may some curvature to the cross pieces 3589*b* and 3589*c* in some non-limiting embodiments.

A first loop handle 4482 may be elongated to define a first forward direction 4483 toward a first handle front 4484, and may be elongated to define a first rearward direction 4485 toward a first handle back 4486 opposite the first handle front 4484. A first loop handle 4482 may have a first cable engagement region 4487 biased toward the first handle front 4484 to define a first forward handle region 4488 between the first handle front 4484 and the first cable engagement region 4487 and a first rearward handle region 4489 between the first handle back 4486 and the first cable engagement region 4487. In a first loop handle 4482 the first rearward handle region may have a closed loop 4481 defining a through hole 4481*a*.

Components that are adapted for snap fit engagement with one or more counterpart snap components are components that are selectably engageable by an interference fit. The interference fit is characterized by having some snap force required to join or separate the components from one another. As used in some embodiments of the crossbow cocking devices disclosed herein, components may be adapted for snap fit engagement wherein the snap force is sufficiently high to permit the joined components to be carried about as an assembly by holding only one component and to be engaged with an associated crossbow without the assembly falling apart, but wherein the cocking force input during a cocking operation is greater than the snap force and sufficient to separate the snap fit components.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the invention, it is now claimed:

We claim:

1. A crossbow cocking system comprising:

a sled having a first arm and a second arm offset from the first arm by a gap of sufficient width to accommodate fitting around an associated trigger assembly of an associated crossbow;

an elongated cocking cable having a first end and a second end offset from the first end;

a first handle engaged to the elongated cocking cable at the first end;

a second handle engaged to the elongated cocking cable at the second end;

a first engagement feature including: a first cavity formed in one of the first arm and the first handle; a first protrusion formed in the other of the first arm and the first handle; a second cavity formed in one of the first arm and the first handle; and a second protrusion formed in the other of the first arm and the first handle; and a second engagement feature including: a first cavity formed in one of the second arm and the second handle; a first protrusion formed in the other of the second arm and the second handle; a second cavity formed in one of the second arm and the second handle; and a second protrusion formed in the other of the second arm and the second handle;

wherein:

(1) the first arm has a bowstring retainer and a pulley that receives the elongated cocking cable;

(2) the second arm has a bowstring retainer and a pulley that receives the elongated cocking cable;

(3) the first handle is selectively engagable to the first arm by: positioning the first protrusion of the first engagement feature into the first cavity of the first engagement feature; and positioning the second protrusion of the first engagement feature into the second cavity of the first engagement feature;

(4) the first handle is selectively dis-engagable from the first arm by: removing the first protrusion of the first engagement feature from the first cavity of the first engagement feature; and removing the second protrusion of the first engagement feature from the second cavity of the first engagement feature to permit an associated user to operate the first handle during a cocking operation with a first hand in a vertical hand position;

(5) the second handle is selectively engagable to the second arm by: positioning the first protrusion of the second engagement feature into the first cavity of the second engagement feature; and positioning the second protrusion of the second engagement feature into the second cavity of the second engagement feature; and (6) the second handle is selectively dis-engagable from the second arm by: removing the first protrusion of the second engagement feature from the first cavity of the second engagement feature; and removing the second protrusion of the second engagement feature from the second cavity of the second engagement feature to permit an associated user to operate the second handle during a cocking operation with a second hand in a vertical hand position.

2. The crossbow cocking system of claim 1 wherein:

the first and second protrusions of the first engagement feature are positioned on a top surface of the first arm;

the first and second cavities of the first engagement feature are positioned on a bottom surface of the first handle;

the first and second protrusions of the second engagement feature are positioned on a top surface of the second arm; and the first and second cavities of the second engagement feature are positioned on a bottom surface of the second handle.

3. The crossbow cocking system of claim 2 wherein:

the first and second protrusions of the first engagement feature are parallel cylindrical studs that have different cross-sections; and the first and second protrusions of the second engagement feature are parallel cylindrical studs that have different cross-sections.

4. The crossbow cocking system of claim 1 wherein:

the first and second protrusions of the first engagement feature are positioned on an end surface of the first handle;

the first and second cavities of the first engagement feature are positioned on an end surface of the first arm;

the first and second protrusions of the second engagement feature are positioned on an end surface of the second handle; and the first and second cavities of the second engagement feature are positioned on an end surface of the second arm.

5. The crossbow cocking system of claim 4 wherein:

the first protrusion of the first engagement feature is positioned on a top surface of the first handle;

the second protrusion of the first engagement feature is positioned on a bottom surface of the first handle;

the first cavity of the first engagement feature is positioned on a top surface of the first arm;

the second cavity of the first engagement feature is positioned on a bottom surface of the first arm;

the first protrusion of the second engagement feature is positioned on a top surface of the second handle;

the second protrusion of the second engagement feature is positioned on a bottom surface of the second handle;

the first cavity of the second engagement feature is positioned on a top surface of the second arm; and the second cavity of the second engagement feature is positioned on a bottom surface of the second arm.

6. The crossbow cocking system of claim 1 wherein:

the first and second protrusions of the first engagement feature are positioned on an inside surface of the first handle;

the first and second cavities of the first engagement feature are positioned on an outside surface of the first arm;

the first and second protrusions of the second engagement feature are positioned on an inside surface of the second handle; and the first and second cavities of the second engagement feature are positioned on an outside surface of the second arm.

7. The crossbow cocking system of claim 6 wherein:

the first protrusion of the first engagement feature is positioned on a top surface of the first handle;

the second protrusion of the first engagement feature is positioned on a bottom surface of the first handle;

the first cavity of the first engagement feature is positioned on a top surface of the first arm;

the second cavity of the first engagement feature is positioned on a bottom surface of the first arm;

the first protrusion of the second engagement feature is positioned on a top surface of the second handle;

the second protrusion of the second engagement feature is positioned on a bottom surface of the second handle;

the first cavity of the second engagement feature is positioned on a top surface of the second arm; and the second cavity of the second engagement feature is positioned on a bottom surface of the second arm.

8. The crossbow cocking system of claim 1 wherein:

each handle is a compact handle elongated to define a forward direction toward a handle front and a rearward direction toward a handle back opposite the handle front;

each handle has a cable engagement region biased toward the handle front to define a forward handle region between the handle front and the cable engagement region;

a rearward handle region is defined between the handle back and the cable engagement region of each handle;

the forward handle region increases in cross-sectional area in the forward direction over at least a portion thereof; and the rearward handle region increases in cross-sectional area in the rearward direction over at least a portion thereof.

9. The crossbow cocking system of claim 1 wherein:

each handle is a transition handle elongated to define a forward direction toward a handle front and a rearward direction toward a handle back opposite the handle front;

each handle has a cable engagement region biased toward the handle front to define a forward handle region between the handle front and the cable engagement region;

a rearward handle region is defined between the handle back and the cable engagement region;

a spur or projection extends from each handle between the forward handle region and the rearward handle region; and the forward handle region has a convex finger receptacle adjacent to and partially defined by the spur.

10. A crossbow cocking system comprising:

a sled having a first arm and a second arm offset from the first arm by a gap;

an elongated cocking cable having a first end and a second end offset from the first end;

a first handle engaged to the elongated cocking cable at the first end;

a second handle engaged to the elongated cocking cable at the second end;

a first engagement feature including at least one cavity formed in one of the first arm and the first handle and at least one protrusion formed in the other of the first arm and the first handle; and a second engagement feature including at least one cavity formed in one of the second arm and the second handle and at least one protrusion formed in the other of the second arm and the second handle;

wherein:

(1) the first arm has a bowstring retainer and a pulley that receives the elongated cocking cable;

(2) the second arm has a bowstring retainer and a pulley that receives the elongated cocking cable;

(3) the first handle is selectively engagable to the first arm by positioning the at least one protrusion of the first engagement feature into the at least one cavity of the first engagement feature;

(4) the first handle is selectively dis-engagable from the first arm by removing the at least one protrusion of the first engagement feature from the at least one cavity of the first engagement feature to permit an associated user to operate the first handle during a cocking operation with a first hand in a vertical hand position;

(5) the second handle is selectively engagable to the second arm by positioning the at least one protrusion of the second engagement feature into the at least one cavity of the second engagement feature; and (6) the second handle is selectively dis-engagable from the second arm by removing the at least one protrusion of the second engagement feature from the at least one cavity of the second engagement feature to permit an associated user to operate the second handle during a cocking operation with a second hand in a vertical hand position.

11. The crossbow cocking system of claim 10 wherein:

the at least one protrusion of the first engagement feature is positioned on a top surface of the first arm;

the at least one cavity of the first engagement feature is positioned on a bottom surface of the first handle;

the at least one protrusion of the second engagement feature is positioned on a top surface of the second arm; and the at least one cavity of the second engagement feature is positioned on a bottom surface of the second handle.

12. The crossbow cocking system of claim 11 wherein:

the at least one protrusion of the first engagement feature is a cylindrical stud;

the at least one protrusion of the second engagement feature is a cylindrical stud; and the at least one protrusion of the first engagement feature is parallel to the at least one protrusion of the second engagement feature.

13. The crossbow cocking system of claim 10 wherein:

the at least one protrusion of the first engagement feature is positioned on an end surface of the first handle;

the at least one cavity of the first engagement feature is positioned on an end surface of the first arm;

the at least one protrusion of the second engagement feature is positioned on an end surface of the second handle; and the at least one cavity of the second engagement feature is positioned on an end surface of the second arm.

14. The crossbow cocking system of claim 10 wherein:

the at least one protrusion of the first engagement feature is positioned on an inside surface of the first handle;

the at least one cavity of the first engagement feature is positioned on an outside surface of the first arm;

the at least one protrusion of the second engagement feature is positioned on an inside surface of the second handle; and the at least one cavity of the second engagement feature is positioned on an outside surface of the second arm.

15. The crossbow cocking system of claim 10 wherein:

each handle is a compact handle elongated to define a forward direction toward a handle front and a rearward direction toward a handle back opposite the handle front;

each handle has a cable engagement region biased toward the handle front to define a forward handle region between the handle front and the cable engagement region;

a rearward handle region is defined between the handle back and the cable engagement region of each handle;

the forward handle region increases in cross-sectional area in the forward direction over at least a portion thereof; and the rearward handle region increases in cross-sectional area in the rearward direction over at least a portion thereof.

16. The crossbow cocking system of claim 10 wherein:

each handle is a transition handle elongated to define a forward direction toward a handle front and a rearward direction toward a handle back opposite the handle front;

each handle has a cable engagement region biased toward the handle front to define a forward handle region between the handle front and the cable engagement region;

a rearward handle region is defined between the handle back and the cable engagement region;

a spur or projection extends from each handle between the forward handle region and the rearward handle region; and the forward handle region has a convex finger receptacle adjacent to and partially defined by the spur.

17. The crossbow cocking system of claim 10 wherein each handle:

is a T-shaped handle elongated to define a forward direction toward a handle front and a rearward direction toward a handle back opposite the handle front;

has a cable engagement region biased toward the handle front defining a forward handle region between the handle front and the cable engagement region; and has a rearward handle region between the handle back and the cable engagement region.

18. The crossbow cocking system of claim 10 wherein each handle:

is a loop handle elongated to define a forward direction toward a handle front and a rearward direction toward a handle back opposite the handle front;

has a cable engagement region biased toward the handle front to define a forward handle region between the handle front and the cable engagement region; and has a rearward handle region having a closed loop defining a through hole between the handle back and the cable engagement region.

19. A crossbow method comprising the steps of:

(A) providing a crossbow having a bowstring;

(B) providing a cocking system comprising: (1) a sled having a first arm and a second arm offset from the first arm by a gap; (2) an elongated cocking cable having a first end and a second end offset from the first end; (3) a first handle engaged to the elongated cocking cable at the first end; (4) a second handle engaged to the elongated cocking cable at the second end; (5) a first engagement feature including a first cavity formed in one of the first arm and the first handle and a first protrusion formed in the other of the first arm and the first handle; and (6) a second engagement feature including a first cavity formed in one of the second arm and the second handle and a first protrusion formed in the other of the second arm and the second handle;

(C) providing the first arm with a bowstring retainer and a pulley that receives the elongated cocking cable;

(D) providing the second arm with a bowstring retainer and a pulley that receives the elongated cocking cable;

(E) providing the crossbow and cocking system to be operable to perform these steps:

(1) engaging the first handle to the first arm by positioning the first protrusion of the first engagement feature into the first cavity of the first engagement feature;

(2) disengaging the first handle from the first arm by removing the first protrusion of the first engagement feature from the first cavity of the first engagement feature;

(3) operating the first handle when disengaged during a cocking operation with a first hand in a vertical hand position;

(4) engaging the second handle to the second arm by positioning the first protrusion of the second engagement feature into the first cavity of the second engagement feature;

(5) disengaging the second handle from the second arm by removing the first protrusion of the second engagement feature from the first cavity of the second engagement feature; and (6) operating the second handle when disengaged during a cocking operation with a second hand in a vertical hand position.

20. The crossbow method of claim 19 wherein:

step (B) comprises the steps of:

providing the first engagement feature with a second cavity formed in one of the first arm and the first handle and a second protrusion formed in the other of the first arm and the first handle; and providing the second engagement feature with a second cavity formed in one of the second arm and the second handle and a second protrusion formed in the other of the second arm and the second handle;

step (E)(1) comprises the step of: engaging the first handle to the first arm by positioning the second protrusion of the first engagement feature into the second cavity of the first engagement feature;

step (E)(2) comprises the step of: disengaging the first handle from the first arm by removing the second protrusion of the first engagement feature from the second cavity of the first engagement feature;

step (E)(4) comprises the step of: engaging the second handle to the second arm by positioning the second protrusion of the second engagement feature into the second cavity of the second engagement feature; and step (E)(5) comprises the step of: disengaging the second handle from the second arm by removing the second protrusion of the second engagement feature from the second cavity of the second engagement feature.

* * * * *